US010962904B2

(12) United States Patent
Saito et al.

(10) Patent No.: US 10,962,904 B2
(45) Date of Patent: Mar. 30, 2021

(54) IMAGE FORMING UNIT ATTACHABLE TO IMAGE FORMING APPARATUS AND PROTECTING IMAGE CARRYING SURFACE

(71) Applicant: Oki Data Corporation, Tokyo (JP)

(72) Inventors: Hisatoshi Saito, Tokyo (JP); Yasushi Nakasone, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 16/710,466

(22) Filed: Dec. 11, 2019

(65) Prior Publication Data

US 2020/0257220 A1 Aug. 13, 2020

(30) Foreign Application Priority Data

Feb. 12, 2019 (JP) ..... JP2019-022587
Aug. 30, 2019 (JP) ..... JP2019-157787

(51) Int. Cl.
*G03G 21/18* (2006.01)
*G03G 15/08* (2006.01)

(52) U.S. Cl.
CPC ..... *G03G 15/0886* (2013.01); *G03G 15/0865* (2013.01); *G03G 21/1832* (2013.01)

(58) Field of Classification Search
CPC ..... G03G 21/1832; G03G 21/0886
USPC ..... 399/114
See application file for complete search history.

(56) References Cited

U.S. PATENT DOCUMENTS

2012/0243906 A1* 9/2012 Watanabe ..... G03G 21/1832 399/114

FOREIGN PATENT DOCUMENTS

JP 2018124362 A 8/2018

* cited by examiner

*Primary Examiner* — Arlene Heredia
(74) *Attorney, Agent, or Firm* — Panitch Schwarze Belisario & Nadel LLP

(57) ABSTRACT

An image forming unit includes an image carrier, a body, a shutter unit, a first guiding portion, and a holding portion. The body holds the image carrier with a portion of the image carrying surface being exposed. The shutter unit includes first and second shutter members. The first shutter member is held by the body, being pivotable about a first rotational axis relative to the body, and includes a first inner surface. The second shutter member is held by the first shutter member, being pivotable about a second rotational axis relative to the first shutter member, and includes a second inner surface and first and second contact portions. The shutter unit is shiftable between a closed state and an open state. The closed state is a state extended with the image carrying surface being covered. The open state is a state with the image carrying surface being exposed.

18 Claims, 24 Drawing Sheets

(V-V CROSS-SECTION)

(W-W CROSS-SECTION)

(V-V CROSS-SECTION)

(W-W CROSS-SECTION)

(V-V CROSS-SECTION)

(W-W CROSS-SECTION)

IMAGE FORMING UNIT ATTACHABLE TO IMAGE FORMING APPARATUS AND PROTECTING IMAGE CARRYING SURFACE

CROSS REFERENCE TO RELATED APPLICATIONS

The present application claims priority from Japanese Patent Application No. 2019-022587 and No. 2019-157787 filed on Feb. 12, 2019, and Aug. 30, 2019, respectively, the entire contents of each which are hereby incorporated by reference.

BACKGROUND

The technology relates to an image forming apparatus that forms an image by an electrophotographic method and an image forming unit to be installed in the image forming apparatus.

The inventors have proposed an electrophotographic image forming apparatus that performs exposure on a photosensitive drum with light to form an electrostatic latent image, attaches a developer to the electrostatic latent image to develop a developer image, and transfers the developer image onto a print medium, for example, as disclosed in Japanese Unexamined Patent Application Publication No. 2018-124362.

SUMMARY

In an image forming apparatus that performs exposure on a photosensitive drum with light to form an electrostatic latent image, attaches a developer to the electrostatic latent image to develop a developer image, and transfers the developer image onto a print medium, there is a possibility of a user's hand touching an image carrier when an image forming unit including the image carrier or a photosensitive drum is attached to or detached from a body of the image forming apparatus. If this occurs, there is a possibility of a decrease in the service life of the image carrier or impairment of the quality of a printed image.

It is desirable to provide a small-sized image forming apparatus that is able to secure a superior image forming performance through protection of the image carrier, and an image forming unit to be installed in the image forming apparatus.

According to one embodiment of the technology, there is provided an image forming unit that includes an image carrier, a body, a shutter unit, a first guiding portion, and a holding portion. The image carrier includes an image carrying surface configured to carry a developer image. The body holds the image carrier with a portion of the image carrying surface being exposed. The shutter unit includes a first shutter member and a second shutter member. The first shutter member is held by the body, being pivotable about a first rotational axis relative to the body. The first shutter member includes a first inner surface. The second shutter member is held by the first shutter member, being pivotable about a second rotational axis relative to the first shutter member. The second rotational axis is parallel or substantially parallel to the first rotational axis. The second shutter member includes a second inner surface, a first contact portion, and a second contact portion. The shutter unit is shiftable between a closed state and an open state. The closed state is a state in which the first shutter member and the second shutter member are extended with the first inner surface and the second inner surface covering the image carrying surface. The open state is a state in which the first shutter member and the second shutter member are folded with the first inner surface and the second inner surface opposing each other and with the image carrying surface being exposed. The first guiding portion is supported by the body, being opposing a non-image-forming region of the image carrying surface other than an image-forming region of the image carrying surface. The first guiding portion comes into contact with the first contact portion during state shifting between the closed state and the open state while restricting movement of the second shutter member in a direction away from the image carrying surface. The holding portion is supported by the body in the non-image-forming region. The holding portion comes into contact with the second contact portion and thereby maintains the open state of the shutter unit.

According to one embodiment of the technology, there is provided an image forming apparatus including an image forming unit. The image forming unit includes an image carrier, a body, a shutter unit, a first guiding portion, and a holding portion. The image carrier includes an image carrying surface configured to carry a developer image. The body holds the image carrier with a portion of the image carrying surface being exposed. The shutter unit includes a first shutter member and a second shutter member. The first shutter member is held by the body, being pivotable about a first rotational axis relative to the body. The first shutter member includes a first inner surface. The second shutter member is held by the first shutter member, being pivotable about a second rotational axis relative to the first shutter member. The second rotational axis is parallel or substantially parallel to the first rotational axis. The second shutter member includes a second inner surface, a first contact portion, and a second contact portion. The shutter unit is shiftable between a closed state and an open state. The closed state is a state in which the first shutter member and the second shutter member are extended with the first inner surface and the second inner surface covering the image carrying surface. The open state is a state in which the first shutter member and the second shutter member are folded with the first inner surface and the second inner surface opposing each other and with the image carrying surface being exposed. The first guiding portion is supported by the body, being opposing a non-image-forming region of the image carrying surface other than an image-forming region of the image carrying surface. The first guiding portion comes into contact with the first contact portion during state shifting between the closed state and the open state while restricting movement of the second shutter member in a direction away from the image carrying surface. The holding portion is supported by the body in the non-image-forming region. The holding portion comes into contact with the second contact portion and thereby maintains the open state of the shutter unit.

DETAILED DESCRIPTION

Some example embodiments of the technology will now be described in detail with reference to the accompanying drawings. Note that the following description is directed to illustrative examples of the technology and not to be construed as limiting to the technology. Factors including, without limitation, dimensions, dimension ratios, arrangements, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Throughout the present specification and the drawings, elements having substantially the same function and configuration are denoted with the same numerals to avoid any redundant description. The description will be provided in the following order.

1. First Example Embodiment
2. Second Example Embodiment
3. Modification Examples

1. First Example Embodiment

[1.1 Configuration of Image Forming Apparatus]

Figure 1:
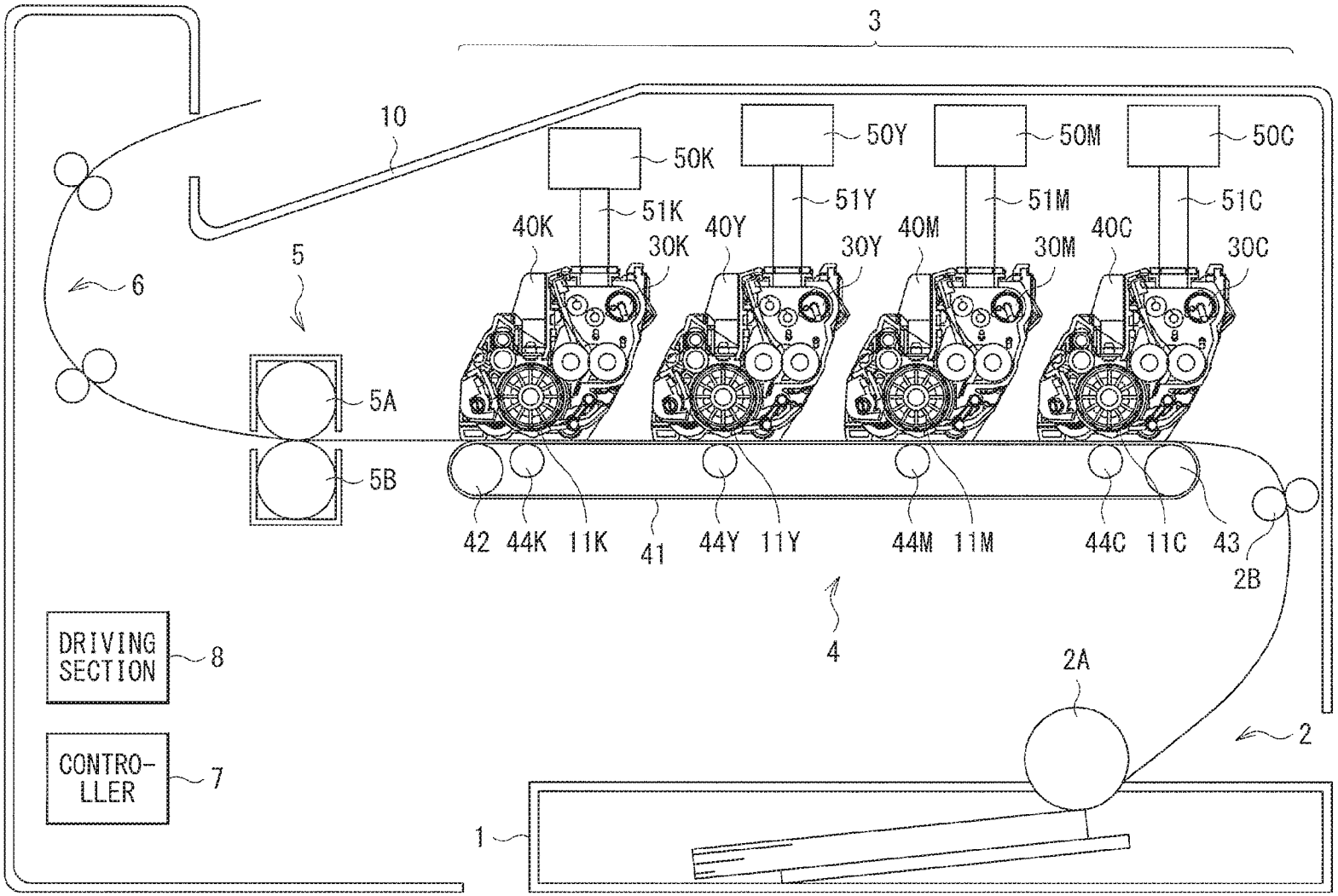
FIG. 1 is a schematic diagram illustrating an overall configuration example of an image forming apparatus according to an example embodiment of the technology.

FIG. 1 is a schematic diagram illustrating an overall configuration example of an image forming apparatus according to a first example embodiment of the technology. The image forming apparatus may correspond to an "image forming apparatus" in one specific but non-limiting embodiment of the technology. The image forming apparatus may be, for example but not limited to, an electrophotographic printer that forms an image such as a color image on a medium PM such a sheet, a film, or any other printable medium. The medium PM may also be referred to as a "print medium" or a "transfer material."

The image forming apparatus illustrated in FIG. 1 may include, inside a housing 10, a medium feeding tray 1 containing the medium PM, a medium conveying section 2, an image forming section 3, a transfer section 4, a fixing section 5, a discharging section 6, a controller 7, and a driving section 8 including a motor. Note that, in the first example embodiment, a conveying direction in which the medium PM is conveyed in the transfer section 4 may be a Y-axis direction, a width direction of the medium PM orthogonal to the conveying direction may be an X-axis direction, and a direction orthogonal to both the X-axis direction and the Y-axis direction may be a Z-axis direction.

[Medium Feeding Tray 1]

The medium feeding tray 1 may contain a plurality of print media PM in a stacked state. The medium feeding tray 1 may be detachably attached to, for example but not limited to, a lower portion of the image forming apparatus.

[Medium Conveying Section 2]

The medium conveying section 2 may include a medium feeding roller 2A and a pair of registration rollers 2B. The medium conveying section 2 may pick up the media PM one by one from the medium feeding tray 1. The medium conveying section 2 may use the medium feeding roller 2A and the registration rollers 2B to convey each media PM to a conveyance path provided between the image forming section 3 and the transfer section 4.

[Image Forming Section 3]

The image forming section 3 may be a mechanism that forms a toner image that are to be transferred onto the medium PM conveyed through the conveyance path. The image forming section 3 may include image forming units 30, exposure devices 40, toner cartridges 50, and toner feeding and conveying paths 51. The image forming units 30 may include image forming units 30C, 30M, 30Y, and 30K. The exposure devices 40 may include exposure devices 40C, 40M, 40Y, and 40K. The toner cartridges 50 may include toner cartridges 50C, 50M, 50Y, and 50K. The toner feeding and conveying paths 51 may include toner feeding and conveying paths 51C, 51M, 51Y, and 51K.

The exposure devices 40 may each perform exposure on a surface of the corresponding photosensitive drum 11 from outside of the corresponding image forming unit 30 and thereby form an electrostatic latent image on the surface of the corresponding photosensitive drum 11. The photosensitive drum 11 will be described later. For example, the exposure devices 40C, 40M, 40Y, and 40K may perform exposure on the surfaces of the photosensitive drums 11C, 11M, 11Y, and 11K from the outside of the image forming units 30C, 30M, 30Y, and 30K and thereby form electrostatic latent images on the surfaces of the photosensitive drums 11C, 11M, 11Y, and 11K, respectively. The exposure devices 40 may each include multiple light-emitting portions for the corresponding photosensitive drum 11. For example, the exposure devices 40C, 40M, 40Y, and 40K may each include multiple light-emitting portions for the photosensitive drums 11C, 11M, 11Y, and 11K, respectively. The light-emitting portions may be arrayed in the width direction orthogonal to the conveying direction of the medium PM. The light-emitting portions may each include, for example but not limited to, a light source and a lens array. The light source may include, for example but not limited to, a light-emitting diode (LED) that emits irradiation light. The lens array may form an image of the irradiation light on the surface of the corresponding one of the photosensitive drums 11C, 11M, 11Y, and 11K.

The toner cartridges 50 are containers that contain respective toners T to be fed to the respective image forming units 30. For example, the toner cartridge 50C may hold a cyan toner TC. The toner cartridge 50M may hold a magenta toner TM. The toner cartridge 50Y may hold a yellow toner TY. The toner cartridge 50K may hold a black toner TK. The cyan toner TC, the magenta toner TM, the yellow toner TY, and the black toner TK may be to be fed to the image forming units 30C, 30M, 30Y, and 30K, respectively. The toner feeding and conveying paths 51 may each couple the corresponding toner cartridge 50 with the corresponding image forming unit 30. Each of the toners of the respective colors stored in the respective toner cartridges 50 may be thereby fed to the corresponding image forming unit 30 through the corresponding toner feeding and conveying path 51. For example, the toner feeding and conveying paths 51C, 51M, 51Y, and 51K may couple the toner cartridges 50C, 50M, 50Y, and 50K with the image forming units 30C, 30M, 30Y, and 30K, respectively. Hence, the toners of the respective colors stored in the toner cartridges 50C, 50M, 50Y, and 50K may be fed to the image forming units 30C, 30M, 30Y, and 30K through the toner feeding and conveying paths 51C, 51M, 51Y, and 51K, respectively.

The image forming units 30 or the image forming units 30C, 30M, 30Y, and 30K may each correspond to an "image forming unit" in a specific but non-limiting embodiment of the technology. The toners T or the toners TC, TM, TY, and TK may each correspond to a "developer" in a specific but non-limiting embodiment of the technology. The configuration of the image forming units 30, i.e., the image forming units 30C, 30M, 30Y, and 30K will be described in detail below.

[Transfer Section 4]

The transfer section 4 may also be referred to as a "transfer belt section." The transfer section 4 may include a transfer belt 41, a driving roller 42, an idler roller 43, and transfer rollers 44. The driving roller 42 may drive the transfer belt 41. The idler roller 43 may be driven by the driving roller 42. The transfer rollers 44 may include transfer rollers 44C, 44M, 44Y, and 44K. The transfer rollers may each be so disposed as to oppose the corresponding photosensitive drum 11 with the transfer belt 41 in between. For example, the transfer rollers 44C, 44M, 44Y, and 44K may be so disposed as to oppose the photosensitive drums 11C, 11M, 11Y, and 11K, respectively, with the transfer belt 41 in between. The driving roller 42 and the idler roller 43 may each be an approximately-columnar member that is rotatable about a rotational axis portion. The rotational axis portion may extend in the width direction, i.e., the X-axis direction. The transfer section 4 may convey the medium PM conveyed from the medium feeding tray 1 toward the downstream fixing section 5 through the medium conveying section 2. The transfer section 4 may sequentially transfer, onto a surface of the medium PM, the toner images formed by the respective image forming units 30, i.e., the image forming units 30C, 30M, 30Y, and 30K.

The transfer belt 41 may be, for example but not limited to, an elastic endless belt including a resin material, such as polyimide resin. The transfer belt 41 may lie on the driving roller 42 and the idler roller 43 while being stretched. The driving roller 42 being controlled by the controller 7 may be driven to rotate in a direction in which the medium PM is conveyed, by rotational force transmitted from the driving section 8. The driving roller 42 may thereby cause the transfer belt 41 to circularly rotate. The driving roller 42 may be disposed upstream of the image forming units 30, i.e., the image forming units 30C, 30M, 30Y, and 30K. The idler roller 43 may adjust the tension applied to the transfer belt 41 by urging force of an urging member. The idler roller 43 may rotate in the same direction as the driving roller 42. The idler roller 43 may be disposed downstream of the image forming units 30, i.e., the image forming units 30C, 30M, 30Y, and 30K.

The transfer rollers 44, i.e., the transfer rollers 44C, 44M, 44Y, and 44K may convey the medium PM in the conveying direction by rotating in a direction opposite to the rotating direction of the photosensitive drums 11, i.e., the photosensitive drums 11C, 11M, 11Y, and 11K, while electrostatically transferring, onto the medium PM, the toner images formed by the image forming units 30, i.e., the image forming units 30Y, 30M, 30C, and 30K. The transfer rollers 44, i.e., the transfer rollers 44C, 44M, 44Y, and 44K may each include, for example but not limited to, a foamable electrically-semiconductive elastic rubber material.

[Fixing Section 5]

The fixing section 5 may apply heat and pressure to the toner images transferred onto the medium PM that has passed through the transfer section 4 and thereby fix the toner images to the medium PM. The fixing section 5 may include, for example but not limited to, an upper roller 5A and a lower roller 5B.

The upper roller 5A and the lower roller 5B may each include a built-in heat source. The heat source may be a heater such as a halogen lamp. The upper roller 5A and the lower roller 5B may thereby serve as heating rollers that apply heat to the toner images on the medium PM. The upper roller 5A being controlled by the controller 7 may be driven to rotate in a direction in which the PM is conveyed in the conveying direction, by rotational force transmitted from the driving section 8. The heat sources in the upper roller 5A and the lower roller 5B may receive a bias voltage controlled by the controller 7 and thereby control the respective surface temperatures of the upper roller 5A and the lower roller 5B. The lower roller 5B may be so disposed to oppose the upper roller 5A that a contact portion is provided between the upper roller 5A and the lower roller 5B. The lower roller 5B may serve as a pressure-applying roller that applies pressure to the toner images on the medium PM. The lower roller 5B may include a surface layer including an elastic material.

[Controller 7]

The controller 7 may execute, for example but not limited to, a predetermined program and thereby comprehensively control processing operation of the image forming apparatus. The controller 7 may include an interface (I/F) control section and a print control section. The I/F control section may receive, for example, print data and a control command from an external device, such as a personal computer (PC) and transmit a signal related to a state of the image forming apparatus. The print control section may include a microprocessor, a read-only memory (ROM), a random-access memory (RAM), and an input-output port. The print control section may receive, for example, print data and a control command from the I/F control section and control print operation.

[1.2 Configuration of Image Forming Unit 30]

Figure 2A:
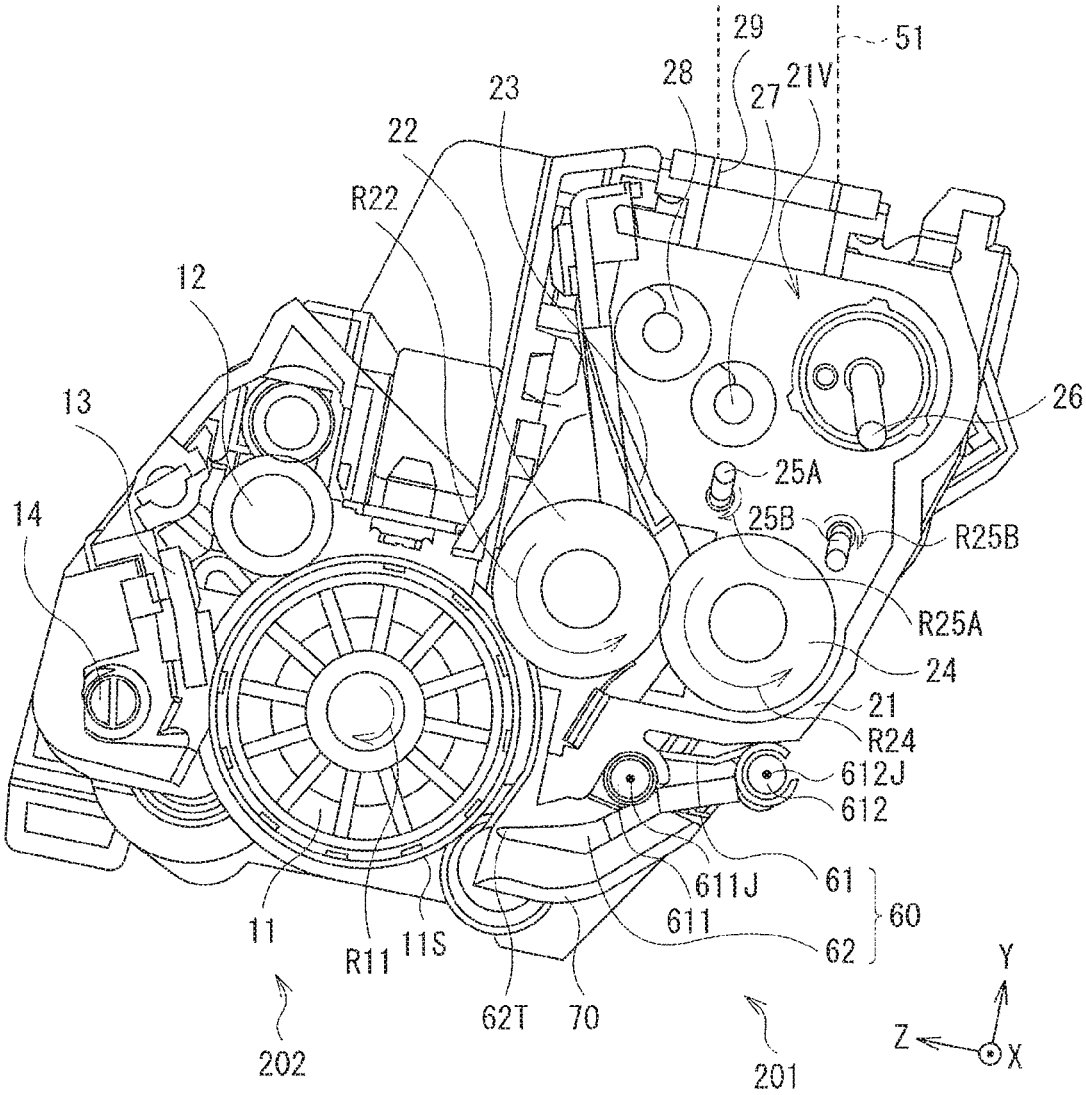
FIG. 2A is a first schematic cross-sectional view of a configuration example of a main part of an image forming unit installed in the image forming apparatus illustrated in FIG. 1.
Figure 2B:
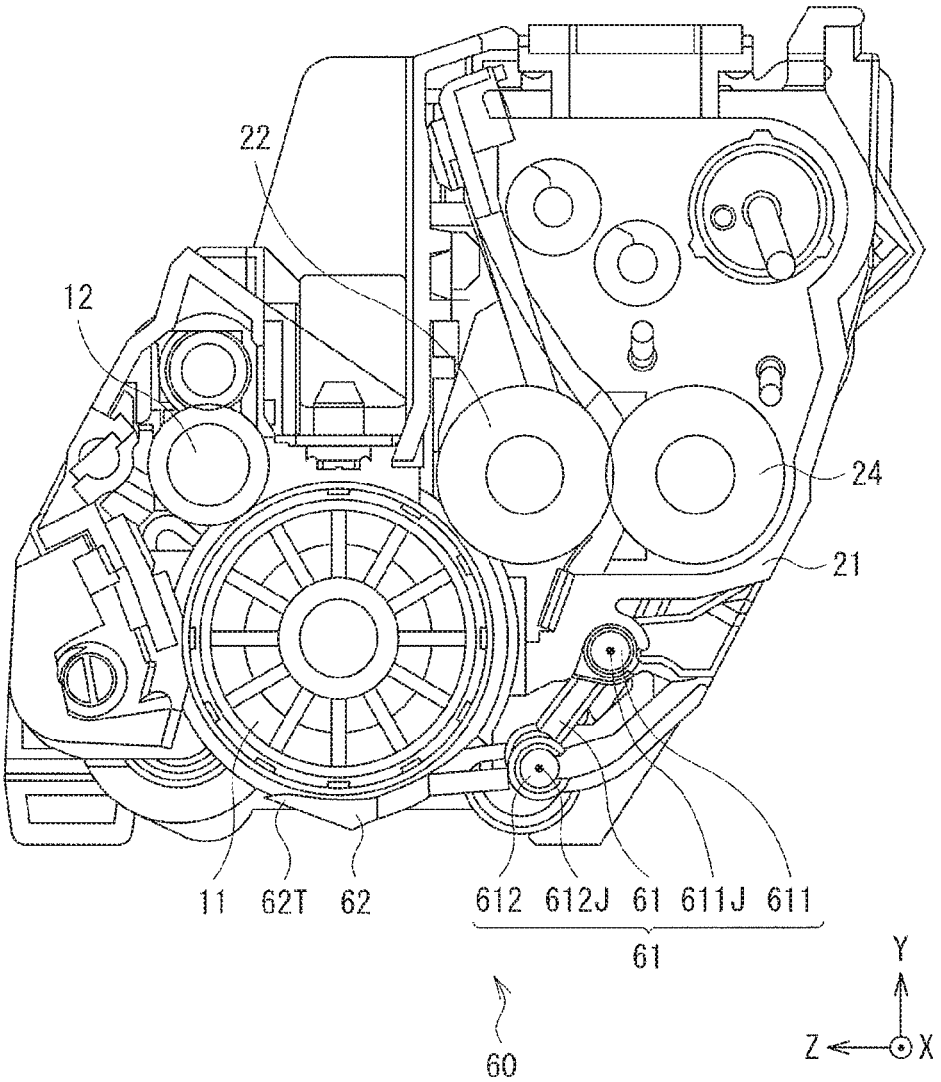
FIG. 2B is a second schematic cross-sectional view of a configuration example of a main part of the image forming unit installed in the image forming apparatus illustrated in FIG. 1.

FIGS. 2A and 2B are schematic cross-sectional views of an overall configuration example of the image forming unit 30 according to an example embodiment of the technology. FIG. 2A illustrates a shutter unit 60 in an open state. FIG. 2B illustrates the shutter unit 60 in a closed state. The shutter unit 60 will be described below. In the first example embodiment, the image forming units 30C, 30M, 30Y, and 30K have substantially the same configuration, except for the types of toners used. Therefore, the image forming units 30C, 30M, 30Y, and 30K will be referred to as the "image forming unit 30," in principle. Similarly, in principle, the exposure devices 40C, 40M, 40Y, and 40K will be simply referred to as the "exposure device 40," the toner cartridges 50C, 50M, 50Y, and 50K will be simply referred to as the "toner cartridge 50," the toner feeding and conveying paths 51C, 51M, 51Y, and 51K will be simply referred to as the "toner feeding and conveying path 51," the transfer rollers 44C, 44M, 44Y, and 44K will be simply referred to as the "transfer roller 44," and the photosensitive drums 11C, 11M, 11Y, and 11K will be simply referred to as the "photosensitive drum 11."

The toner may include, for example but not limited to, non-magnetic materials including a binder resin, an internal additive, and an external additive. Non-limiting examples of the binder resin may include polyester resin. The internal additive may serve as a charge control agent, a release agent, and a colorant. Non-limiting examples of the external additive may include silica and titanium oxide. The color of the toner image formed by the image forming unit 30 may be changed by appropriately selecting the color of the colorant.

The image forming unit 30 may include a developing device 201 and a drum unit 202, as illustrated in FIG. 2A. The toner feeding and conveying path 51 may be attached to an upper portion of the developing device 201. The toner feeding and conveying path 51 may be coupled to the toner cartridge 50.

[Developing Device 201]

The developing device 201 may include, in an internal space 21V of a housing 21, for example, a developing roller 22, a developer blade 23, a feeding roller 24, stirring members 25A and 25B, a toner-amount detector 26, a first toner-conveying spiral 27, and a second toner-conveying spiral 28.

An upper portion of the housing 21 to which the toner feeding and conveying path 51 is coupled may have an inlet 29. The toner T may be input through the inlet 29. The inlet 29 may be disposed in a portion of the housing 21 other than the two ends in the width direction, i.e., the X-axis direction. In one example embodiment, the inlet 29 may be provided in a middle portion of the housing 21 in the width direction. The internal space 21V of the housing 21 may temporarily contain the toner T fed from the toner cartridge 50. The housing 21 may correspond to a "body" in one specific but non-limiting example embodiment of the technology.

The developing roller 22 may be an approximately-columnar rotary body. The developing roller 22 may carry the toner on its surface and feed the toner to the photosensitive drum 11. The developing roller 22 may also develop the electrostatic latent image carried on the image carrying surface 11S of the photosensitive drum 11 with the toner. The developing roller 22 may be so opposed to the photosensitive drum 11 that the surface of the developing roller 22 is in contact with the photosensitive drum 11. The developing roller 22 may include, for example but not limited to, a shaft and an elastic layer that covers an outer circumferential surface of the shaft. The shaft of the developing roller 22 may be an approximately-columnar member including a material having favorable electrical conductivity. Such a material may include, for example but not limited to, a metal material, such as iron (Fe), aluminum (Al), or stainless steel. The elastic layer of the developing roller 22 may include, for example but not limited to, a rubber material, such as silicone rubber or urethane. In a specific but not-limiting example, the rubber material may have base polymers of polyether-based polyol and aliphatic-based isocyanate. The elastic layer of the developing roller 22 may contain a conductive agent for adjustment of a resistance value of the elastic layer. The conductive agent may be carbon black, such as acetylene black or Ketjenblack, for example. The developing roller 22 being controlled by the controller 7 may be driven to rotate in the same direction as the feeding roller 24 by rotational force transmitted from the driving section 8. For example, the developing roller 22 may rotate in a counterclockwise direction, which is opposite to the rotating direction of the photosensitive drum 11, as indicated by an arrow R22 in FIG. 2A.

The developer blade 23 may be a toner controlling member that forms a toner layer, i.e., a layer of the toner T, on the surface of the rotating developing roller 22 and control or adjust a thickness of the toner layer. The developer blade 23 may be, for example but not limited to, a plate-like elastic member or a flat spring that includes stainless steel, such as JIS SUS304 which is a kind of stainless steel based on Japanese Industrial Standards (JIS). The developer blade 23 may be so disposed that a tip of the plate-like elastic member is in slight contact with the surface of the developing roller 22.

The feeding roller 24 may be an approximately-columnar rotary body disposed in a lowest portion of the internal space 21V on opposite side from the inlet 29. The feeding roller 24 may serve as a developer feeding member that feeds the toner T to the developing roller 22. The feeding roller 24 may have a double-layered structure including, for example but not limited to, a shaft or a core metal and an elastic layer covering an outer circumferential surface of the shaft, as illustrated in FIG. 2A. In one example, the feeding roller 24 may further include a coating layer covering the outer circumferential surface, i.e., a surface, of the elastic layer of the feeding roller 24. The shaft of the feeding roller 24 may be an approximately-columnar member including a material having favorable electrical conductivity. Such a material may include, for example but not limited to, a metal material, such as iron (Fe), aluminum (Al), free-cutting steel, or stainless steel. The material of the elastic layer of the feeding roller 24 may include, for example but not limited to, a foamable elastic material containing a plurality of cells or pores. In a specific but not-limiting example, a rubber material, such as foamable silicone rubber or foamable urethane, may be suitably used. The feeding roller 24 may be so disposed that the surface of the feeding roller 24 is in contact with the surface of the developing roller 22. The feeding roller 24 being controlled by the controller 7 may be driven to rotate by rotational force transmitted from the driving section 8. The feeding roller 24 may rotate in the same direction as the developing roller 22 about the shaft extending in the X-axis direction. In the example, the feeding roller 24 may rotate in the counterclockwise direction as indicated by an arrow R24 in FIG. 2A. The rotation of the feeding roller 24 may cause the toner T to be fed to the surface of the developing roller 22. Thus, the surface of the feeding roller 24 and the surface of the developing roller 22 may move in opposite directions at the contact portions of the feeding roller 24 and the developing roller 22.

The stirring members 25A and 25B may be rotary members that stir the toner present in the internal space 21V of the housing 21. The stirring members 25A and 25B may each be, for example but not limited to, a cranked rod having a diameter of several millimeters. The stirring members 25A and 25B being controlled by the controller 7 may receive rotational force from the driving section 8. The stirring members 25A and 25B may be driven to rotate about, for example but not limited to, rotational axes extending in the X-axis direction by rotational force from the driving section 8, for example. The stirring members 25A and 25B may rotate in synchronization in, for example but not limited to, the directions indicated by arrows R25A and R25B in FIG. 2 at, for example but not limited to, a constant rotating speed. As illustrated in FIG. 2A, the stirring members 25A and 25B may rotate in a clockwise direction. The stirring members 25A and 25B may be disposed between the feeding roller 24 and the first toner-conveying spiral 27.

The first toner-conveying spiral 27 may be disposed in the internal space 21V of the housing 21. The first toner-conveying spiral 27 may be driven to rotate by the rotational force from the driving section 8. The rotating first toner-conveying spiral 27 may thereby convey the toner in the X-axis direction while stirring the toner T. The first toner-conveying spiral 27 being controlled by the controller 7 may receive a rotational force from the driving section 8. The first toner-conveying spiral 27 may be disposed between the toner-amount detector 26 and the second toner-conveying spiral 28 in a horizontal direction, as illustrated in FIG. 2A. In one example embodiment, the first toner-conveying spiral 27 may be disposed at, for example but not limited to, a position diagonally downward from the toner-amount detector 26 and the second toner-conveying spiral 28. In one example embodiment, the first toner-conveying spiral 27 may be disposed, for example but not limited to, directly below the inlet 29 of the housing 21 in the vertical direction, for example.

The second toner-conveying spiral 28 may be disposed in the internal space 21V of the housing 21, as with the first toner-conveying spiral 27. The second toner-conveying spiral 28 being controlled by the controller 7 may be driven to rotate by a rotational force transmitted from the driving section 8. The second toner-conveying spiral 28 may thereby convey the toner T in the X-axis direction while stirring the toner T. The second toner-conveying spiral 28 may be disposed between a wall of the housing 21 and the first toner-conveying spiral 27 in the horizontal direction, as illustrated in FIG. 2A. In one example embodiment, the second toner-conveying spiral 28 be disposed at, for example but not limited to, a position diagonally upward from the first toner-conveying spiral 27.

The toner-amount detector 26 illustrated in FIG. 2A may detect an amount of the toner T remaining in the internal space 21V of the housing 21. The toner-amount detector 26 may be disposed in the internal space 21V of the housing 21 on opposite side to the second toner-conveying spiral 28 with the first toner-conveying spiral 27 in between in the horizontal direction. That is, the toner-amount detector 26 may be disposed between the first toner-conveying spiral 27 and the wall of the housing 21 on opposite side to the second toner-conveying spiral 28 in the horizontal direction. In one example embodiment, the toner-amount detector 26 may be disposed at a position diagonally upward from the first toner-conveying spiral 27.

The developing device 201 may further include a shutter unit 60 and a guiding member 70. The shutter unit 60 and the guiding member 70 may be supported by, for example but not limited to, the housing 21. The shutter unit 60 and the guiding member 70 will be described in detail below.

[Drum Unit 202]

The components of the drum unit 202 of the image forming unit 30 will now be described with reference to FIGS. 2A and 2B.

The drum unit 202 may include inside, for example but not limited to, the housing 21 shared with the developing device 201, the photosensitive drum 11, a charging roller 12, a cleaning blade 13, and a toner conveying spiral 14.

The photosensitive drum 11 may be an approximately-columnar member configured to carry an electrostatic latent image on its surface, i.e., an image carrying surface 11S. The photosensitive drum 11 may include a photoreceptor, e.g., an organic photoreceptor. In a specific but non-limiting example, the photosensitive drum 11 may include an electrically-conductive support and a photoconductive layer covering an outer circumferential surface, i.e., a surface, of the conductive support. The electrically-conductive support may include, for example but not limited to, a metallic pipe of aluminum. The photoconductive layer may have a structure in which a charge generation layer and a charge transport layer are stacked in order, for example. The photosensitive drum 11 may be so held by the housing 21 that a portion of the image carrying surface 11S is exposed and the photosensitive drum 11 is rotatable. The photosensitive drum 11 being controlled by the controller 7 may be driven to rotate at a predetermined rotating speed in a rotating direction R11 indicated by an arrow. The rotating direction R11 may be a direction in which the medium PM is conveyed in the conveying direction. The image carrying surface 11S may correspond to an "image carrying surface" in one specific but non-limiting embodiment of the technology.

The charging roller 12 may be a member that electrically charges a surface, i.e., a superficial portion, of the photosensitive drum 11. The charging roller 12 may be disposed in contact with the image carrying surface 11S of the photosensitive drum 11. The charging roller 12 may include, for example but not limited to, a metallic shaft and an electrically-semiconductive rubber layer covering an outer circumferential, i.e., a surface, of the metallic shaft. The electrically-semiconductive rubber layer may include, for example but not limited to, an electrically-semiconductive epichlorohydrin rubber layer. The charging roller 12 may rotate in the same direction as the photosensitive drum 11, for example.

The cleaning blade 13 may scrape off and collect the toner T remaining on the image carrying surface 11S of the photosensitive drum 11. The cleaning blade 13 may thereby clean the image carrying surface 11S of the photosensitive drum 11. The cleaning blade 13 may be disposed in contact with the image carrying surface 11S at a counter angle. In other words, the cleaning blade 13 may project in a direction opposite to the rotating direction R11 of the photosensitive drum 11. The cleaning blade 13 having such a configuration may include, for example but not limited to, an elastic body, such as polyurethane rubber.

The toner conveying spiral 14 may convey the toner T scraped off by the cleaning blade 13 in, for example but not limited to, the X-axis direction and discharge the toner T outside the housing 21.

[Shutter Unit 60]

Figure 3:
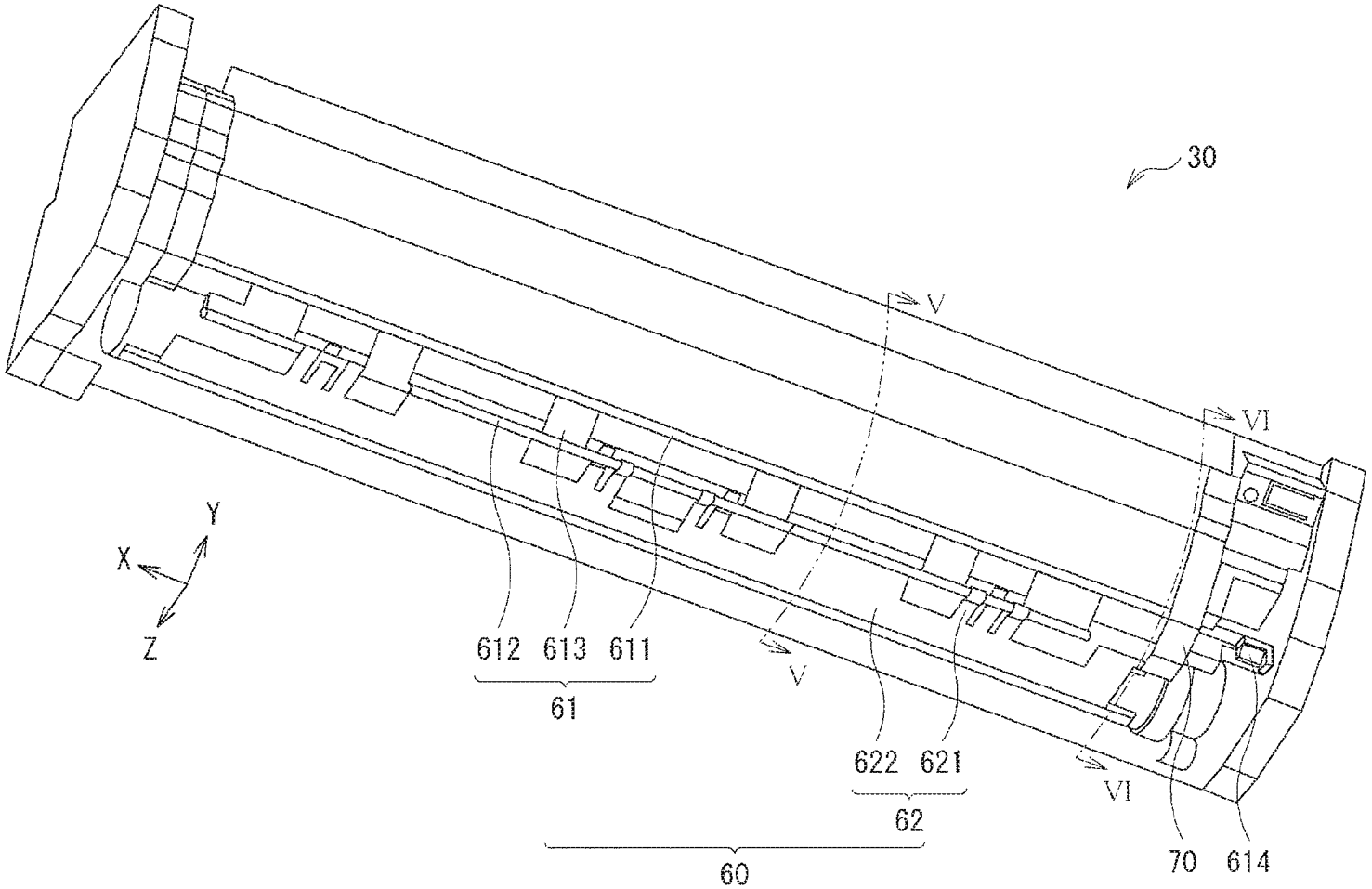
FIG. 3 is a perspective view of an exterior of the image forming unit installed in the image forming apparatus illustrated in FIG. 1.
Figure 4A:
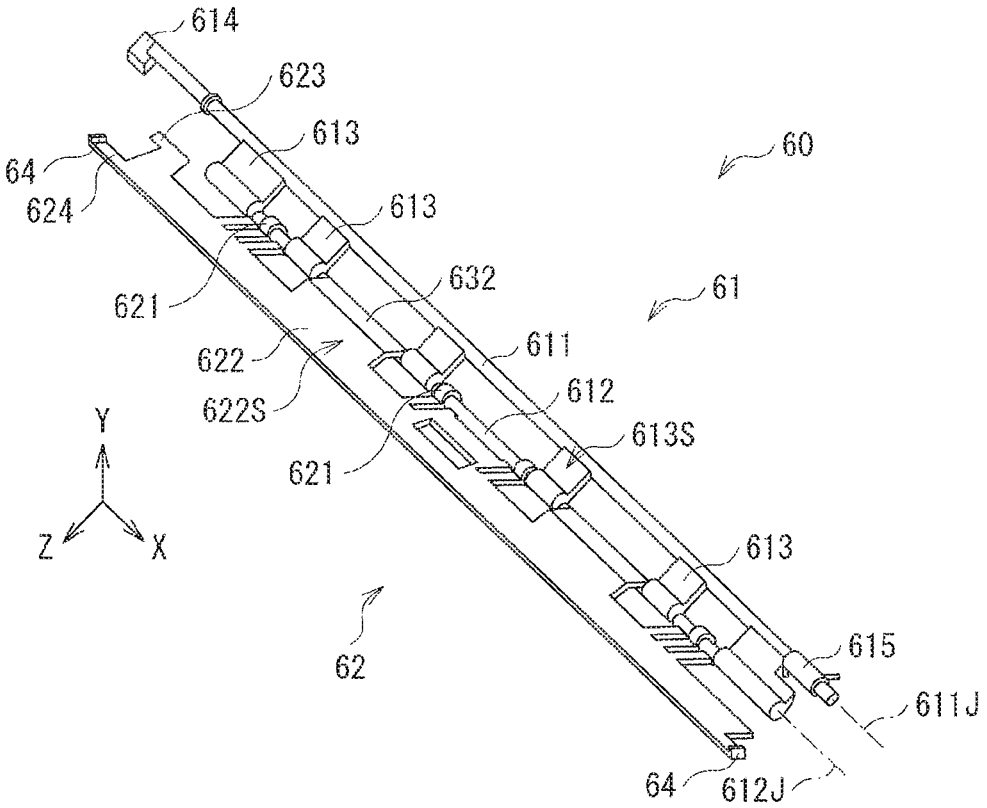
FIG. 4A is a first perspective view of an exterior of a shutter unit illustrated in FIG. 3.
Figure 4B:
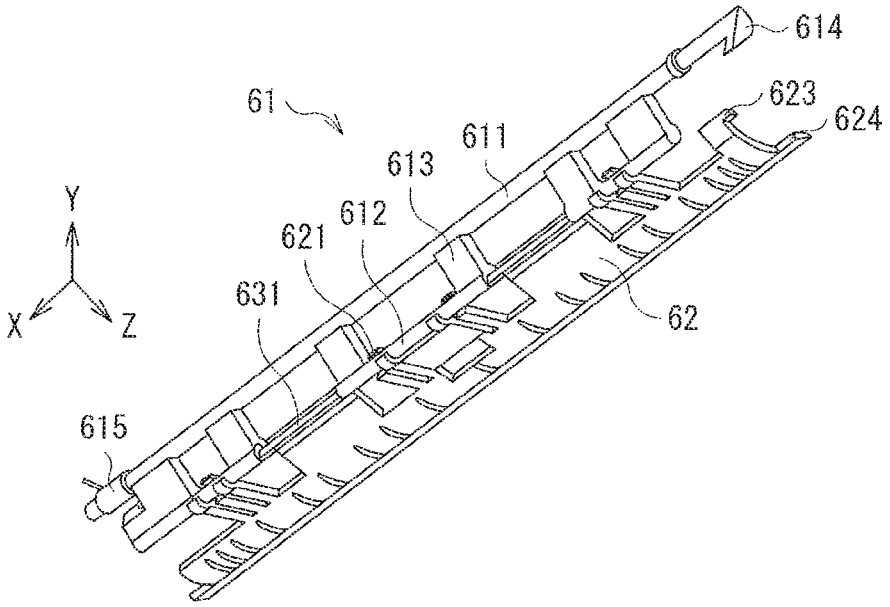
FIG. 4B is a second perspective view of the exterior of the shutter unit illustrated in FIG. 3.

A detailed configuration of the shutter unit 60 of the developing device 201 will now be described with reference to FIGS. 3, 4A, and 4B. FIG. 3 is a perspective view of the exterior of the image forming unit 30 from diagonally below. FIGS. 4A and 4B are perspective views of the exterior of the shutter unit 60. FIG. 4A illustrates the exterior of the shutter unit 60 viewed from the photosensitive drum 11. FIG. 4B illustrates the exterior of the shutter unit 60 viewed from side opposite to the photosensitive drum 11.

The shutter unit 60 may be so supported by the housing 21 as to be able to cover a portion of the image carrying surface 11S of the photosensitive drum 11 exposed from the housing 21. The shutter unit 60 includes a first shutter member 61 and a second shutter member 62. The shutter unit 60 may be shiftable between a closed state and an open state by changing of the postures of the first shutter member 61 and the second shutter member 62 relative to the housing 21. In the closed state, the shutter unit 60 may be extended and thereby cover a portion of the image carrying surface 11S of the photosensitive drum 11. In the open state, the shutter unit 60 may be retracted and thereby allow a larger portion of the image carrying surface 11S of the photosensitive drum 11 to be exposed.

The shutter unit 60 may correspond to a "shutter unit" in a specific but non-limiting embodiment of the technology. The first shutter member 61 may correspond to a "first shutter member" in a specific but non-limiting embodiment of the technology. The second shutter member 62 may correspond to a "second shutter member" in a specific but non-limiting embodiment of the technology.

The first shutter member 61 may include a first shaft 611, a second shaft 612, and a first flat portion 613. The first shaft 611 may be a round bar extending in the X-axis direction. The second shaft 612 may be a round bar extending in a direction parallel or substantially parallel to the first shaft 611. The first flat portion 613 may have a flat shape and couple the first shaft 611 and the second shaft 612 to each other. The first flat portion 613 may be fixed to both the first shaft 611 and the second shaft 612. The first flat portion 613 may have a first inner surface 613S that is able to be opposed to the image carrying surface 11S in the closed state. A first end of the first shaft 611 may be provided with a lever 614. A second end of the first shaft 611 on opposite side to the lever 614 may be provided with a spring 615. The spring 615 may serve as an urging member. In the first example embodiment, two or more first flat portions 613 may be dispersedly disposed between the lever 614 at the first end and the spring 615 at the second end. The first shutter member 61 may be held by the housing 21 and be pivotable, relative to the housing 21, about a rotational axis 611J of the first shaft 611. A portion of the second shaft 612 in the X-axis direction may be provided with a first rotation-angle restrictor 631 having a first contact surface 631S. See FIG. 5A for the first contact surface 631S. See FIG. 4B for the first rotation-angle restrictor 631.

The lever 614 may be integrated with the first shaft 611. The lever 614 may come into contact with, for example but not limited to, a protrusion 10T disposed on the inner surface of the housing 10 and receive a rotational force from the protrusion 10T. The lever 614 may thereby rotate the first shaft 611 or the first shutter member 61. The protrusion 10T is described below with reference to FIGS. 7A to 7C.

The spring 615 may be an urging member that applies, to the first shutter member 61, an urging force directed to shifting from the open state to the closed state.

The second shutter member 62 may be held by the first shutter member 61 and be pivotable, relative to the first shutter member 61, about a rotational axis 612J of the second shaft 612. The second shutter member 62 may include a grasping portion 621 and a second flat portion 622. The grasping portion 621 may hold the second shaft 612 in a rotatable manner. The second flat portion 622 may be fixed to the grasping portion 621. In the example embodiment, a plurality of grasping portions 621 may be disposed in the gaps between the first flat portions 613. The second flat portion 622 may have a second inner surface 622S that is able to oppose the image carrying surface 11S in the closed state. A portion of the second flat portion 622 may be provided with a second rotation-angle restrictor 632 at a position corresponding to the first rotation-angle restrictor 631, as illustrated in FIG. 4A. The second rotation-angle restrictor 632 may have a second contact surface 632S that comes into contact with the first contact surface 631S in the closed state. See FIG. 5A for the second contact surface 632S. The second shutter member 62 may have a first contact portion 623 and a second contact portion 624 that come into contact with the guiding member 70 described below. The first contact portion 623 and the second contact portion 624 may be disposed in a non-image-forming region positioned on the outer side of an image-forming region on the image carrying surface 11S in a longitudinal direction of the image forming unit 30, i.e., the X-axis direction. The image-forming region may be a region in which the image to be transferred onto the medium PM is to be formed. The first contact portion 623 may correspond to a "first contact portion" in a specific but non-limiting embodiment of the technology. The second contact portion 624 may correspond to a "second contact portion" in a specific but non-limiting embodiment of the technology.

Figure 5A:
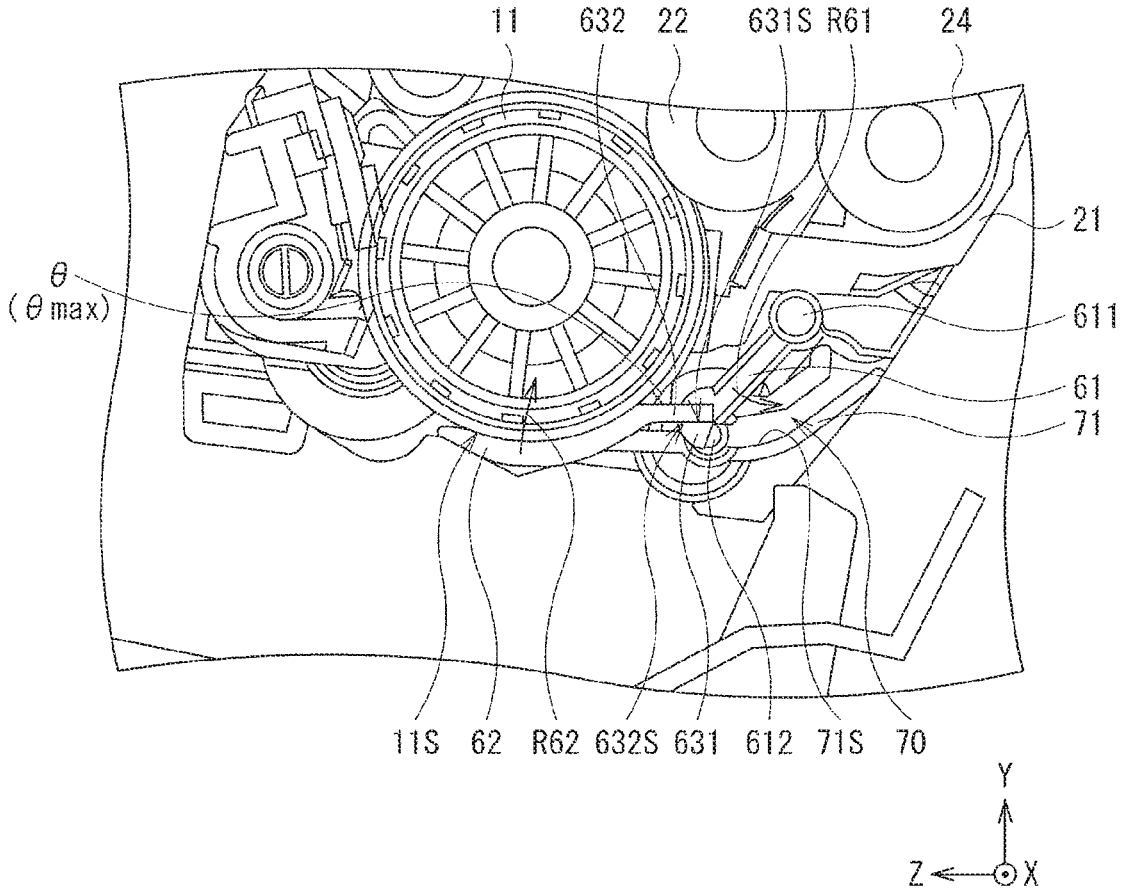
FIG. 5A is a first cross-sectional view of the shutter unit and its vicinity in a closed state, of the image forming unit illustrated in FIG. 3.
Figure 5B:
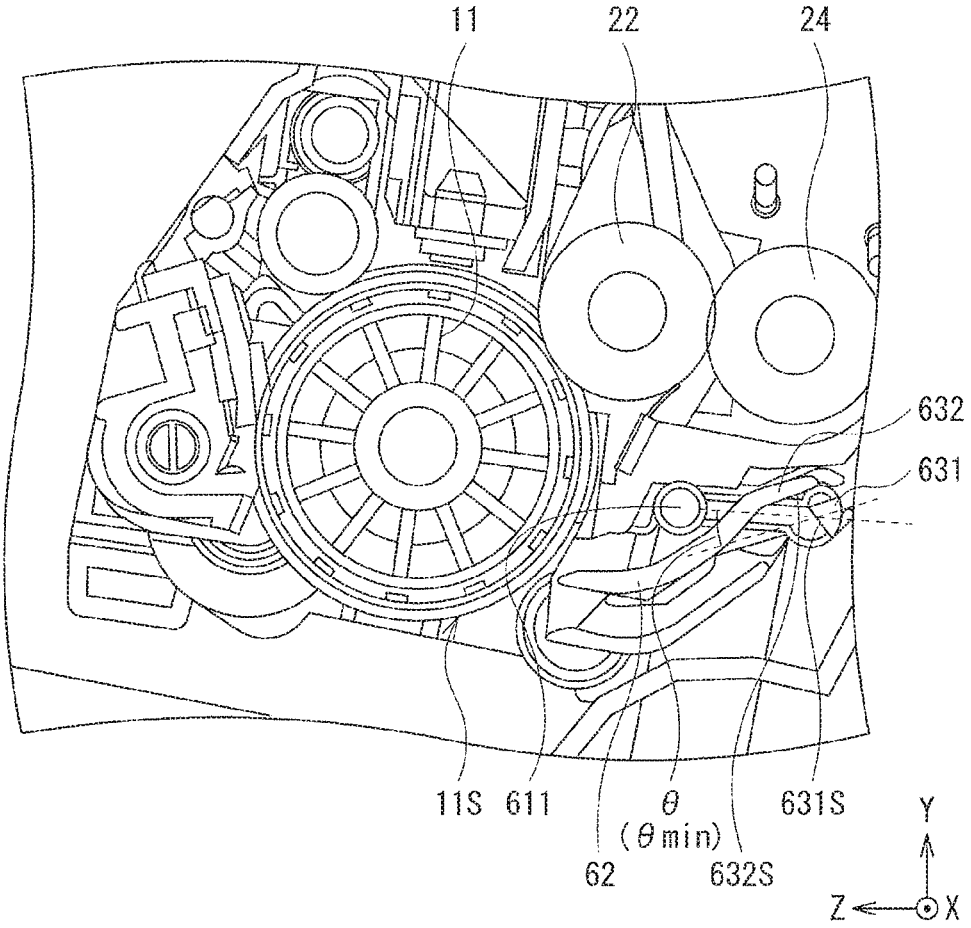
FIG. 5B is the first cross-sectional view of the shutter unit and its vicinity in an open state, of the image forming unit illustrated in FIG. 3.
Figure 5C:
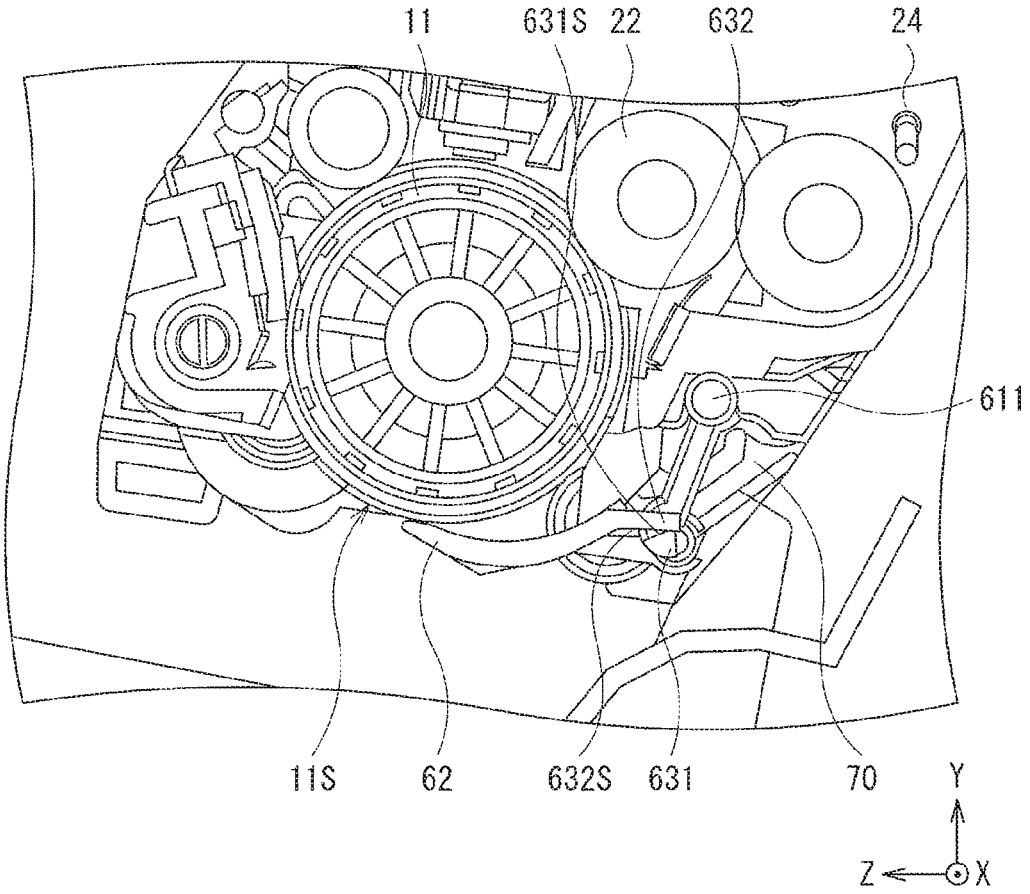
FIG. 5C is the first cross-sectional view of the shutter unit and its vicinity in a middle state, of the image forming unit illustrated in FIG. 3.
Figure 6A:
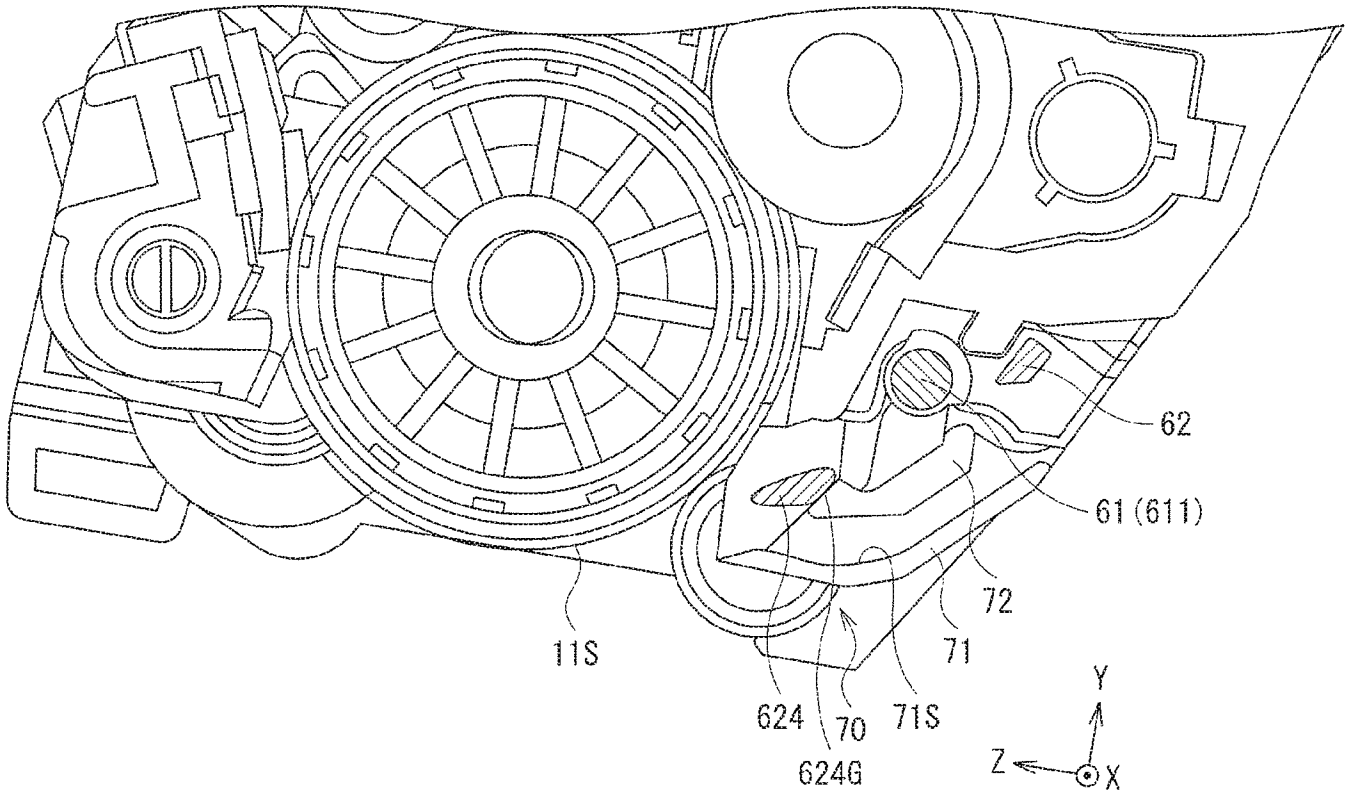
FIG. 6A is a second cross-sectional view of the shutter unit and its vicinity in the open state, of the image forming unit illustrated in FIG. 3.
Figure 6B:
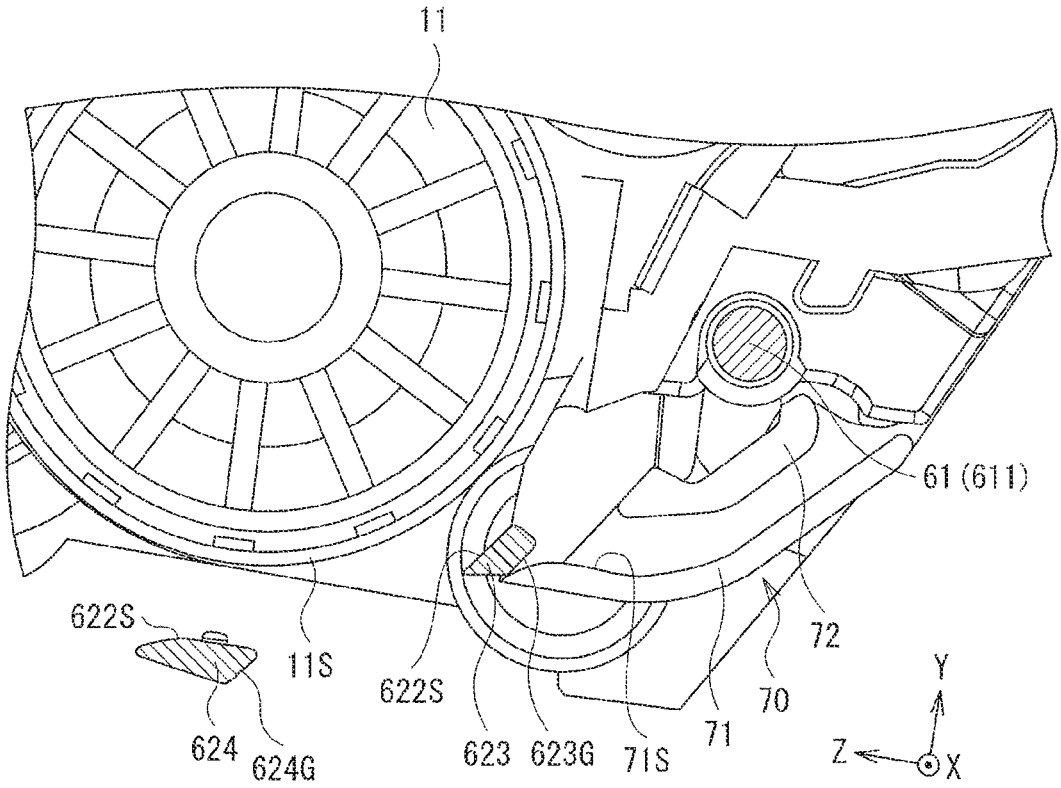
FIG. 6B is the second cross-sectional view of the shutter unit and its vicinity in the middle state, of the image forming unit illustrated in FIG. 3.

FIGS. 5A to 5C are schematic cross-sectional views of the shutter unit 60 and its vicinity. FIGS. 5A to 5C illustrate cross-sections taken along a line V-V in FIG. 3. FIG. 5A illustrates the shutter unit 60 in the closed state. FIG. 5B illustrates the shutter unit 60 in the open state. FIG. 5C illustrates the shutter unit 60 in a middle state. The middle state may be an intermediary state between the closed state and the open state. FIGS. 6A and 6B illustrate cross-sections taken along a line VI-VI in FIG. 3. FIG. 6A illustrates the shutter unit 60 in the closed state. FIG. 6A illustrates a state in which a holding portion 72 of the guiding member 70 is in contact with an outer surface 624G of the second contact portion 624, thereby maintaining the open state of the shutter unit 60. In the open state, the second contact portion 624 may be so held by the holding portion 72 that a portion or all of the second contact portion 624 is disposed on or above the holding portion 72. The outer surface 624G of the surface of the second contact portion 624 may refer to a region of the surface, of the second contact portion 624, other than the inner surface opposing the image carrying surface 11S of the photosensitive drum 11. FIG. 6B illustrates a state in which the shutter unit 60 shifts from the closed state to the open state, i.e., that is a state at a time when a portion of the second shutter member 62 comes into contact with a guiding surface 71S of a guiding portion 71 of the guiding member 70. The portion of the second shutter member 62 may be, for example but not limited to, an outer surface 623G described below.

The first contact surface 631S and the second contact surface 632S of the shutter unit 60 may come into contact with each other in the closed state, as illustrated in FIG. 5A. This may restrict an angle of the second shutter member 62 relative to the first shutter member 61. That is, the shifting of the shutter unit 60 from the open state to the closed state may cause an angle θ between the first inner surfaces 613S and the second inner surface 622S to vary from the minimum angle θ min to the maximum angle θmax. When the shutter unit 60 reaches the closed state, the first contact surface 631S and the second contact surface 632S may come into contact with each other, thereby restricting the angle θ not to exceed the predetermined maximum angle θmax.

The first contact surface 631S and the second contact surface 632S may respectively correspond to a "first contact surface" and a "second contact surface" in a specific but non-limiting embodiment of the technology.

In the closed state of the shutter unit 60, the first shutter member 61 and the second shutter member 62 may be so extended that the first inner surfaces 613S and the second inner surface 622S surface the image carrying surface 11S, as illustrated in FIG. 5A. In the open state, the first shutter member 61 and the second shutter member 62 may be so folded that the first inner surfaces 613S and the second inner surface 622S oppose each other, as illustrated in FIG. 5B. In the open state, the angle θ may be the minimum angle θ min.

In one example embodiment, the shutter unit 60 may shift between the closed state and the open state without protruding from a region overlaying the housing 21 on the cross-section orthogonal to the X axis. One reason for this is that the space swept by the shutter unit 60 upon the state shifting may be secured without an increase in the dimension of the housing 21, and this may be advantageous for the downsizing of the overall configuration of the image forming unit 30.

In one example embodiment, the second inner surface 622S of the second shutter member 62 may have ribs 64, as illustrated in FIG. 4A. The ribs 64 may be able to come into contact with the non-image-forming region outside the image-forming region of the image carrying surface 11S. One reason for this is that, in the closed state of the shutter unit 60, the second inner surface 622S of the second shutter member 62 may come into contact with the image-forming region of the image carrying surface 11S, and thereby, the image-forming region of the image carrying surface 11S may be reliably prevented from being damaged.

[Guiding Member 70]

The guiding member 70 may be supported by the housing 21. The guiding member 70 may include the guiding portion 71 having the guiding surface 71S, as illustrated in FIGS. 6A and 6B. The guiding portion 71 may be disposed at a position away from the first shaft 611 and the photosensitive drum 11. The guiding portion 71 may come into contact with the outer surface 623G while guiding the second shutter member 62. The outer surface 623G may be disposed on side of the first contact portion 623 of the second shutter member 62 opposite to the second inner surface 622S. The guiding portion 71 may restrict the second shutter member 62 from moving in a direction away from the image carrying surface 11S during state shifting of the shutter unit 60.

In one example embodiment, on the cross-section orthogonal to the X axis, a first distance from the first shaft 611 to the guiding surface 71S of the guiding member 70 may be larger than a second distance from the first shaft 611 to the second shaft 612. In this way, the guiding member 70 may not interfere or directly come into contact with the first shaft 611 when the shutter unit 60 shifts between the open state and the closed state. The guiding member 70 may be disposed outside the image-forming region of the image carrying surface 11S in the X-axis direction. Interference between the guiding member 70 and the shutter unit 60 may thereby be prevented when the shutter unit 60 shifts between the open state and the closed state.

In one example embodiment, on the cross-section orthogonal to the X axis, a third distance from the image carrying surface 11S to the guiding surface 71S of the guiding member 70 may be larger than a fourth distance from the image carrying surface 11S to the first shaft 611. One reason for this is that the space swept by the shutter unit 60 during the state shifting of the shutter unit 60 is reduced.

With reference to FIGS. 2A and 2B, in one example embodiment, on the cross-section orthogonal to the X axis, a first length from the rotational axis 611J of the first shaft 611 to the rotational axis 612J of the second shaft 612 may be smaller than a second length from the rotational axis 612J of the second shaft 612 to the tip of the second shutter member 62 on opposite side to the rotational axis 612J. One reason for this is that the first shutter member 61 may have a length smaller than that of the second shutter member 62, and thereby, the space swept by the shutter unit 60 during the state shifting may be reduced.

In one example, the guiding member 70 may further include the holding portion 72. The holding portion 72 may come into contact with the second contact portion 624 of the second shutter member 62 in the open state, as illustrated in FIG. 6A. The holding portion 72 may thereby hold the posture of the folded shutter unit 60. The holding portion 72 may come into contact with the outer surface 624G of the second contact portion 624 in the open state. The second shutter member 62 may thereby be prevented from sagging, by its weight, below the housing 21 and interfering with another component, such as the transfer section 4. In one example embodiment, in the open state, the guiding surface 71S of the guiding portion 71 of the guiding member 70 may be disposed away from the outer surface 623G of the first contact portion 623.

[1.3 Example Workings and Example Effects]

[A. Basic Operation]

In the image forming apparatus, a toner image may be transferred onto the medium PM as follows.

When print image data and a print command are inputted from an external device to the controller 7 of the activated image forming apparatus, the controller 7 may cause the components of the image forming apparatus to start a printing operation for the print image data in response to the print command. Non-limiting examples of the external device may include a personal computer (PC.)

The stack of media PM in the medium feeding tray 1 may be picked up one by one from the top by a component such as a pickup roller, as illustrated in FIG. 1, for example. The picked-up medium PM may be conveyed in a direction indicated by an arrow Y1 toward the image forming section 3 disposed downstream while the skew of the media PM is corrected by the feeding roller. The image forming section 3 may transfer a toner image onto the medium PM as follows.

The image forming section 3 may form the toner image of each color through the following electrophotographic process in response to the print command given by the controller 7. In one specific but non-limiting example, the controller 7 may start the driving section 8. The driving section 8 may cause the toner in the toner cartridge 50 to be input to the internal space 21V of the housing 21 through the inlet 29. The driving section 8 may also drive the photosensitive drum 11 to rotate at a constant speed in a direction indicated by an arrow Y11. As a result, the charging roller 12, the developing roller 22, and the feeding roller 24 may also start rotating in a predetermined direction.

The controller 7 may apply a predetermined voltage to the charging roller 12 of each color, and thereby electrically charge the surface of the photosensitive drum 11 of each color uniformly. The controller 7 may thereafter activate the exposure devices 40. The exposure devices 40 may each irradiate the photosensitive drum 11 of the corresponding color with light corresponding to the color component of the print image based on an image signal. In this way, an electrostatic latent image may be formed on the surface of the photosensitive drum 11 of each color.

The toner T may be fed to the developing roller 22 via the feeding roller 24 and carried on the surface of the developing roller 22. The developing roller 22 may attach the toner T to the electrostatic latent image on the photosensitive drum 11 and thereby form a toner image. A predetermined voltage may be applied to the transfer roller 44 of the transfer section 4. The application of the voltage may generate an electric field between the photosensitive drum 11 and the transfer roller 44. When the medium PM passes between the photosensitive drum 11 and the transfer roller 44 while the electric field is generated, the toner image on the photosensitive drum 11 may be transferred onto the medium PM. In the image forming apparatus, the image carrying surface 11S may come into direct contact with the medium PM, and thereby, the toner image may be transferred onto the medium PM.

The toner image on the medium PM may thereafter receive heat and pressure at the fixing section 5 and thereby be fixed to the medium PM. The medium PM with the fixed toner image may be conveyed in a direction indicated by an arrow Y4 in FIG. 1 and discharged from a discharging section into a stacker outside the image forming apparatus.

[B. State Shifting Operation of Shutter Unit 60]

Figure 7A:
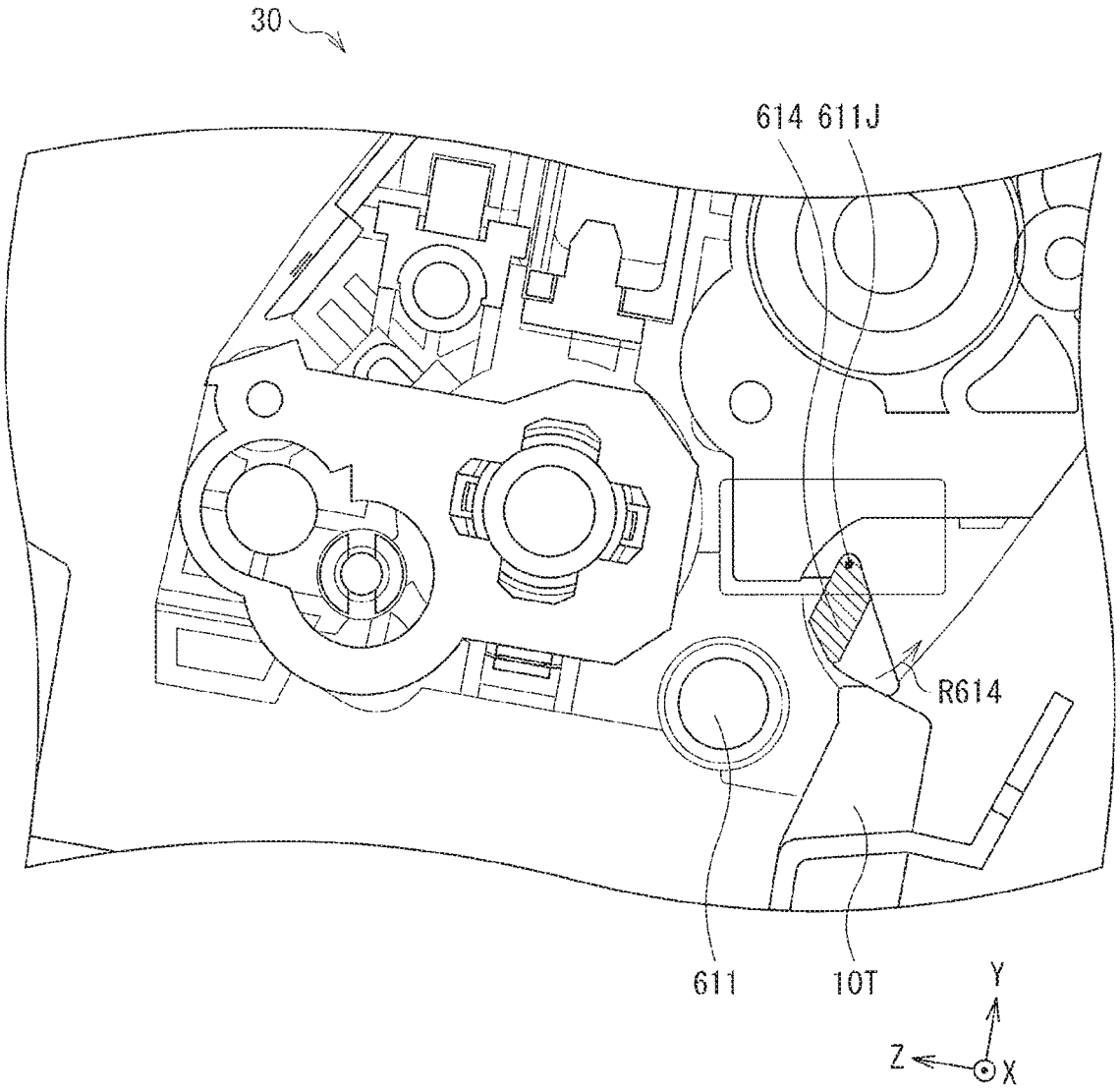
FIG. 7A is a cross-sectional view of the shutter unit illustrated in FIG. 3 during a state shifting operation.
Figure 7B:
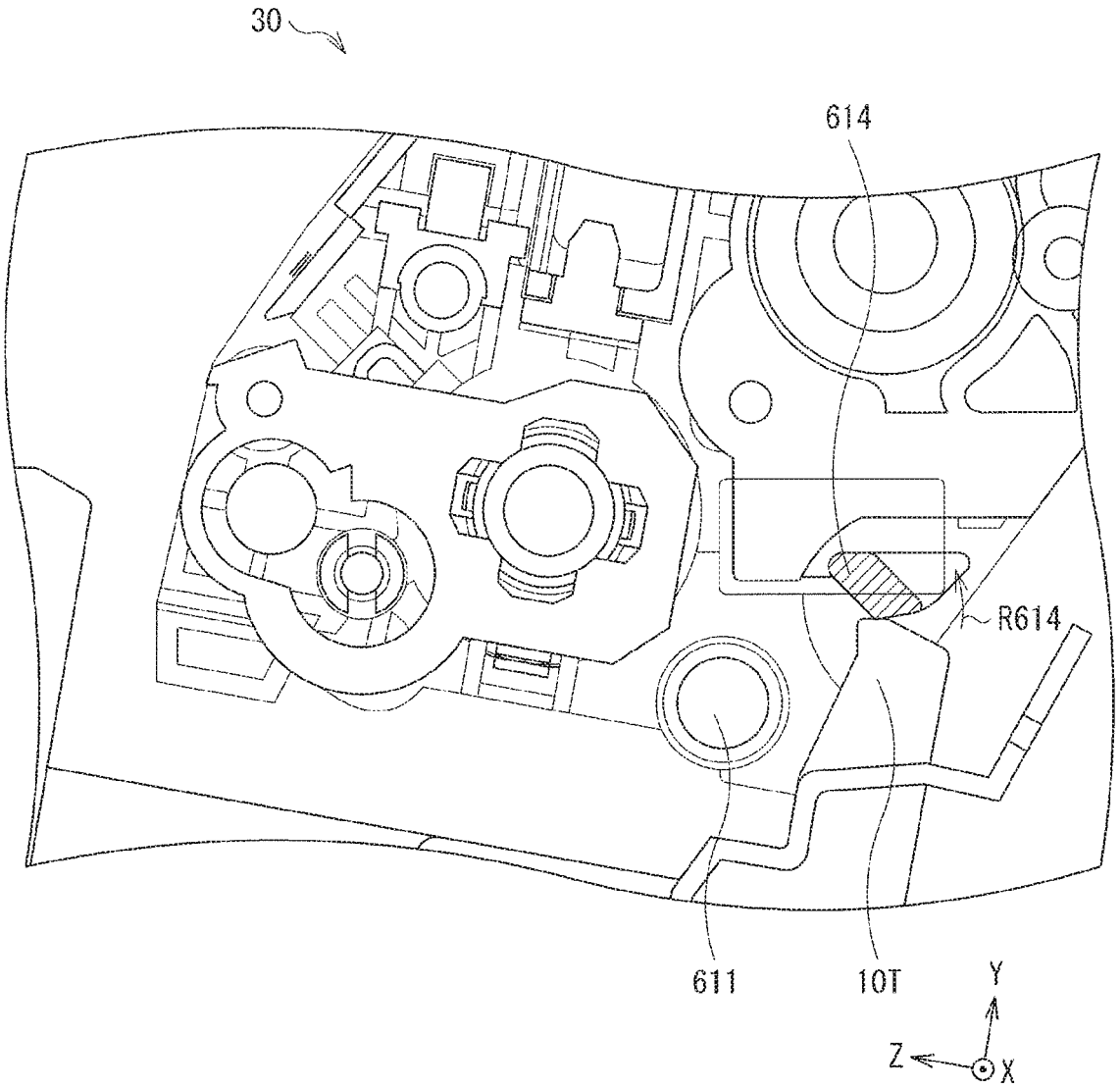
FIG. 7B is a cross-sectional view of the shutter unit during the state shifting operation following FIG. 7A.
Figure 7C:
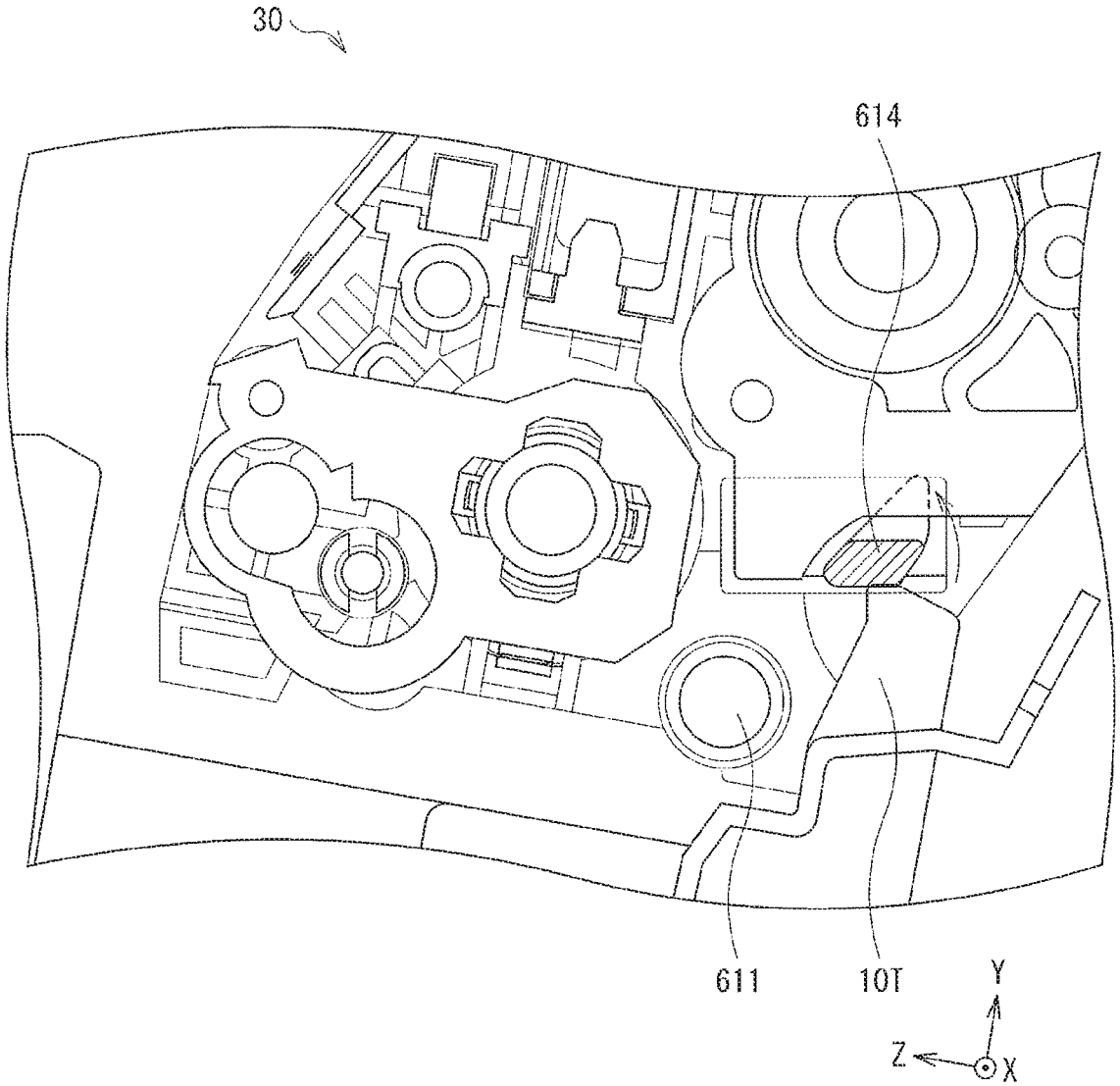
FIG. 7C is a cross-sectional view of the shutter unit during the state shifting operation following FIG. 7B.

In the example embodiment, when the image forming unit 30 is mounted at a predetermined position inside the housing 10, the shutter unit 60 in the closed state may shift to the open state. The state shifting operation of the shutter unit 60 will now be described with reference to FIGS. 7A to 7C. FIGS. 7A to 7C are enlarged cross-sectional views of a main part of the image forming unit 30 during mounting of the image forming unit 30 at the predetermined position inside the housing 10.

The image forming unit 30 may approach the housing 10 from the above. The protrusion 10T disposed inside the housing 10 may come into contact with the lever 614, as illustrated in FIG. 7A. In this way, the lever 614 may start rotating about the rotational axis 611J in the rotating direction R614 indicated by an arrow.

As the image forming unit 30 continues to move downward, the lever 614 may further rotate in the rotating direction R614, as illustrated in FIG. 7B. The lever 614 may continue to rotate in the rotating direction R614 to the final position illustrated in FIG. 7C. FIG. 7C illustrates a state in which the mounting of the image forming unit 30 at the predetermined position is completed.

In the shutter unit 60, the lever 614 and the first shaft 611 may rotate together. The lever 614 may come into contact with the protrusion 10T and rotate in the rotating direction R614 from the position illustrated in FIG. 7A to the position illustrated in FIG. 7C. The first shutter member 61 and the second shutter member 62 may thereby start, in association with each other, state shifting from the closed state illustrated in FIG. 5A to the open state. At this time, the first contact surface 631S of the first rotation-angle restrictor 631 may separate from the second contact surface 632S of the second rotation-angle restrictor 632, as illustrated in FIG. 5C, and the outer surface 623G of the first contact portion 623 may come into contact with the guiding surface 71S of the guiding portion 71, as illustrated in FIG. 6B. The outer surface 623G may be guided by the guiding member 70 while the state shifts to the open state illustrated in FIG. 5B. The guiding member 70 may so guide the outer surface 623G as described above as to restrict the second shutter member 62 from sagging, by its weight, to the outside of the housing 21 in a direction away from the image carrying surface 11S due to the separation of the first contact surface 631S and the second contact surface 632S. The guiding of the outer surface 623G by the guiding member 70 may be able to prevent the second shutter member 62 from being separated from the image carrying surface 11S by its weight during the state shifting. During the state shifting, the first shutter member 61 may rotate in a first rotating direction R61 relative to the housing 21, and the second shutter member 62 may rotate in a second rotating direction R62 relative to the first shutter member 61. The second rotating direction R62 may be a direction opposite to the first rotating direction R61. The first rotating direction R61 and the second rotating direction R62 are illustrated in FIG. 5A. When the state shifts from the closed state to the open state, the first rotating direction R61 may be the counterclockwise direction, and the second rotating direction R62 may be the clockwise direction, as illustrated in FIG. 5A, for example. The rotating directions may be reversed when the state shifts from the open state to the closed state. The holding portion 72 coming into contact with the second contact portion 624 in the open state, as illustrated in FIG. 6A, may restrict the second shutter member 62 from sagging below the housing 21 by its weight and thereby interfering with another component, such as the transfer section 4.

In contrast, when the image forming unit 30 mounted at the predetermined position in the housing 10 is removed from the housing 10, the shutter unit 60 may perform the operations described above in a reversed order. The lever 614 may be constantly receiving an urging force from the spring 615. Therefore, when the image forming unit 30 is lifted upward away from the housing 10, the lever 614 may come into contact with the protrusion 10T and also rotate in a direction opposite to the rotating direction R614 from the position illustrated in FIG. 7C to the position illustrated in FIG. 7A. In this way, the first shutter member 61 and the second shutter member 62 may cause, in association with each other, the state shifting of the shutter unit 60 from the open state illustrated in FIG. 5B to the closed state illustrated in FIG. 5A. During the shifting from the open state to the closed state, the outer surface 623G may be guided by the guiding member 70.

[C. Example Workings and Example Effects of Image Forming Apparatus]

In the first example embodiment, the shutter unit 60 and the guiding member 70 may have the configurations described above. Therefore, the shutter unit 60 may be able to smoothly shift from the closed state to the open state, regardless of the position of the photosensitive drums 11 relative to the housing 21 and the posture of the image forming units 30 relative to the housing 21. In the closed state, the image carrying surface 11S may be covered. In the open state, the image carrying surface 11S may be exposed. Furthermore, it is possible to reduce the space swept by the shutter unit 60 during the state shifting. As a result, according to the image forming units 30 and the image forming apparatus according to the first example embodiment, it is possible to secure a superior image forming performance by protecting the image carrying surface 11S while achieving a small size.

In the first example embodiment, the first shutter member 61 may include the first rotation-angle restrictor 631 having the first contact surface 631S. The second shutter member 62 may include the second rotation-angle restrictor 632 having the second contact surface 632S. The first contact surface 631S and the second contact surface 632S may come into contact with each other in the closed state. The angle θ of the second shutter member 62 relative to the first shutter member 61 may thereby be restricted. Accordingly, the shutter unit 60 may support itself in the closed state without depending on the guiding member 70. That is, a separate component for supporting the second shutter member 62 in the closed state may not be needed. Therefore, an unnecessary component may not be provided at a position covering the image carrying surface 11S in the open state. As a result, the exposure of the image carrying surface may not be interfered during use or during image formation.

2. Second Example Embodiment

[2.1 Configuration of Image Forming Unit 130]

Figure 8A:
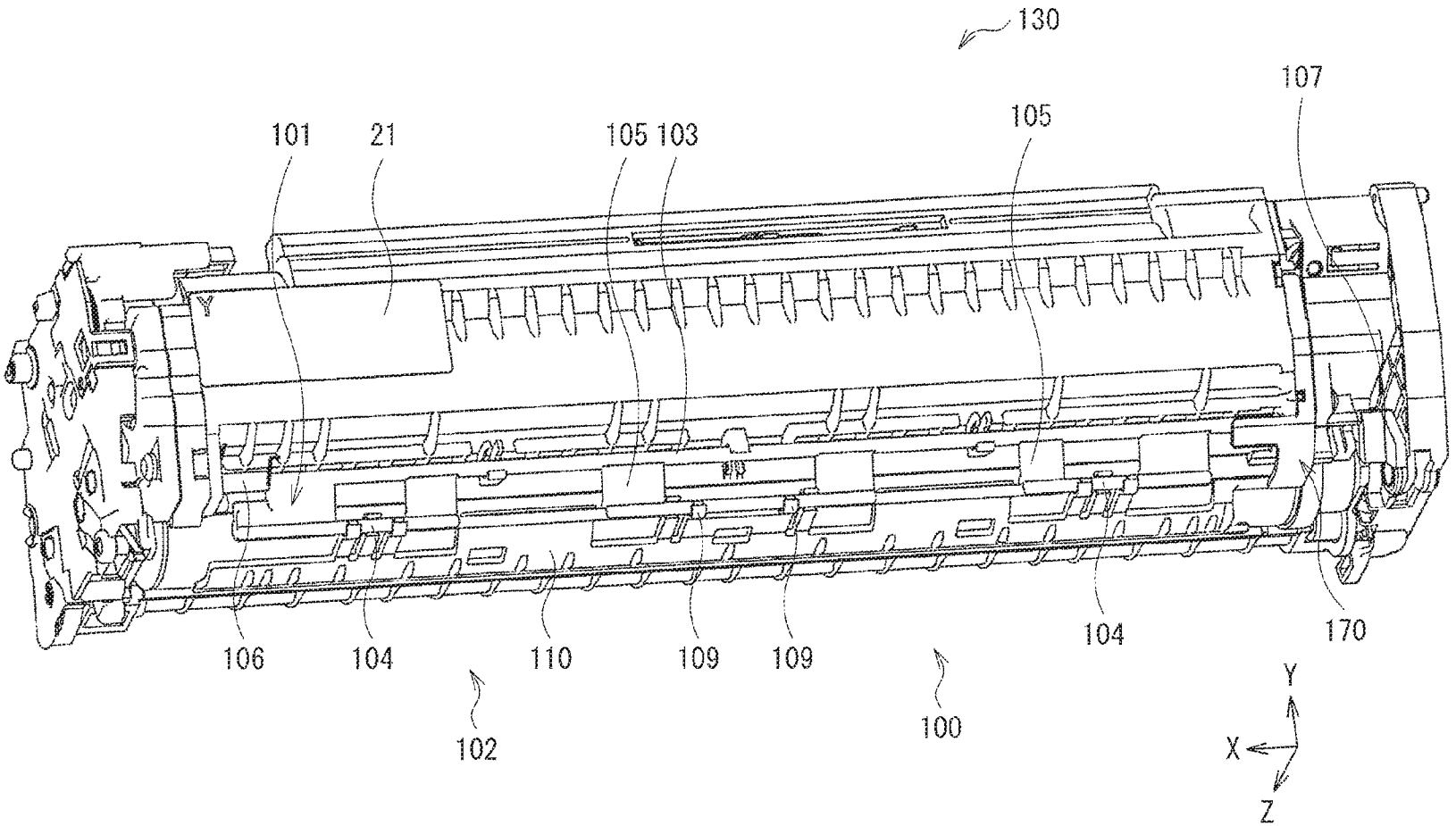
FIG. 8A is a first perspective view of an exterior of an image forming unit according to an example embodiment of the technology.
Figure 8B:
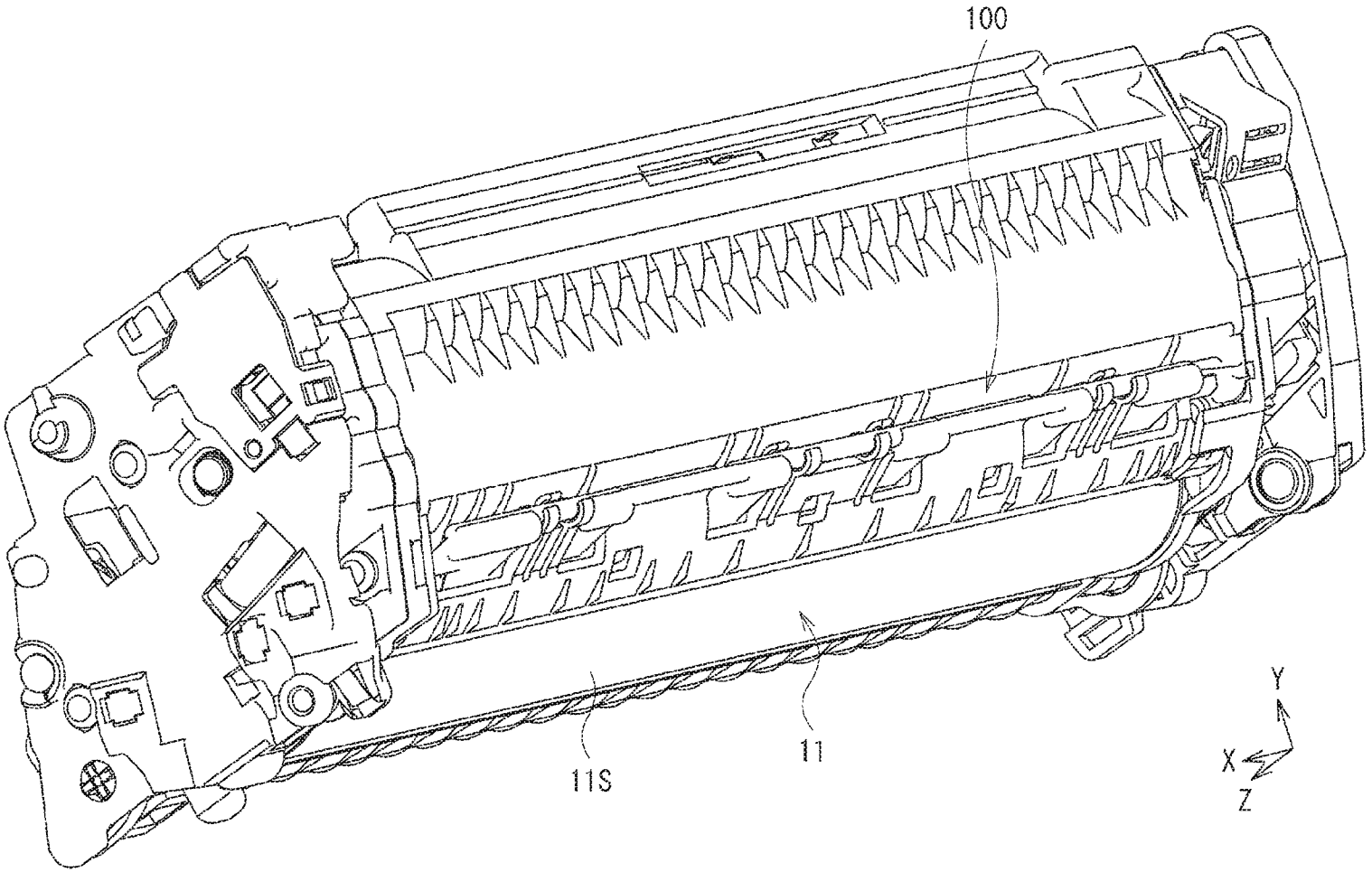
FIG. 8B is a second perspective view of the exterior of an image forming unit according to an example embodiment of the technology.

An image forming unit 130 according to a second example embodiment of the technology will now be described. FIGS. 8A and 8B are perspective views of an overall configuration example of the image forming unit 130 from diagonally downward. The image forming unit 130 may be mountable to the image forming apparatus illustrated in FIG. 1, in a manner similar to the image forming unit 30 according to the first example embodiment described above. As illustrated in FIGS. 8A and 8B, the image forming unit 130 may include a shutter unit 100 and a guiding member 170 respectively in place of the shutter unit 60 and the guiding member 70. The shutter unit 100 and the guiding member 170 will be described below. FIG. 8A illustrates the shutter unit 100 in the closed state. FIG. 8B illustrates the shutter unit 100 in the open state. The image forming unit 130 may have substantially the same configuration as the image forming units 30, except for these differences. Thus, in the description below, the components that differ from those of the image forming unit 30 will be described, and the components that are the same or substantially the same as those of the image forming unit 30 will be not be described.

[2.2 Configuration of Shutter Unit 100]

Figure 9A:
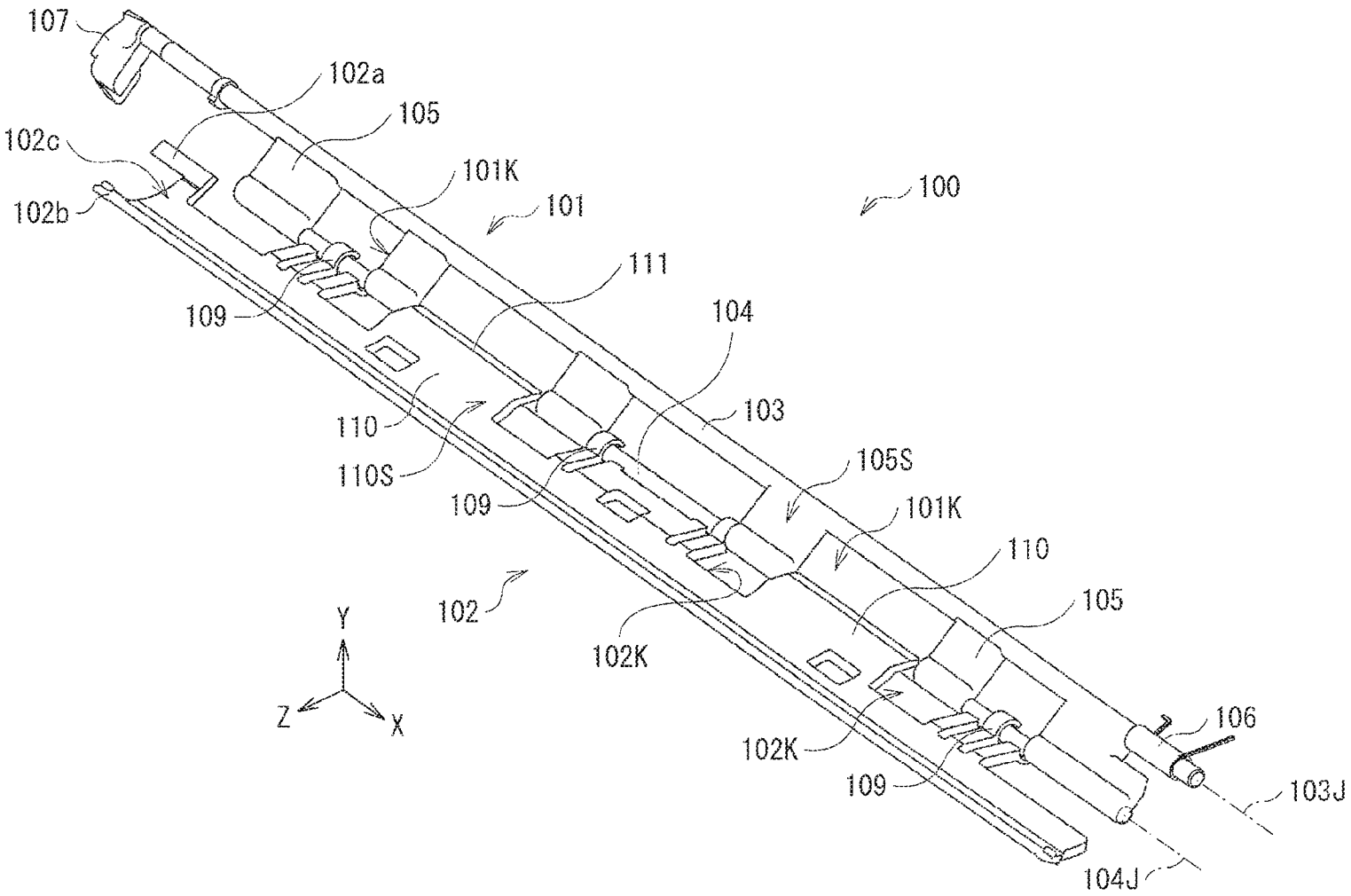
FIG. 9A is a first perspective view of an exterior of a shutter unit illustrated in FIG. 8A.
Figure 9B:
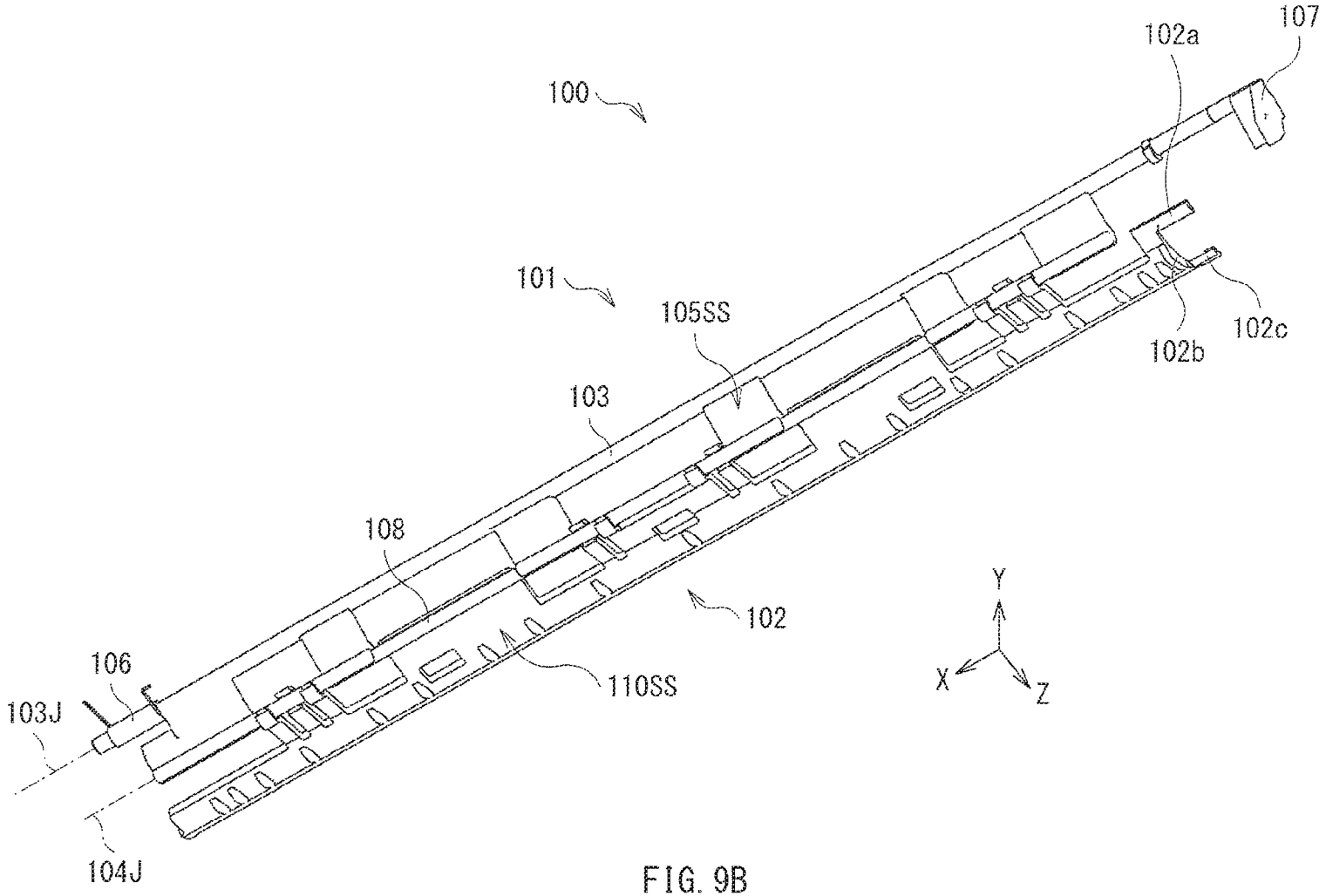
FIG. 9B is a second perspective view of the exterior of the shutter unit illustrated in FIG. 8A.

A detailed configuration of the shutter unit 100 will now be described with reference to FIGS. 8A, 8B, and 9A to 14B. FIGS. 9A and 9B are perspective views of the exterior of the shutter unit 100. FIG. 9A illustrates the exterior of the shutter unit 100 viewed from the photosensitive drum 11. FIG. 9B illustrates the exterior of the shutter unit 100 viewed from side opposite to the photosensitive drum 11.

The shutter unit 100 may be so supported by the housing 21 as to cover a portion of the image carrying surface 11S of the photosensitive drum 11 exposed from the housing 21. The shutter unit 100 may include a first shutter member 101 and a second shutter member 102. The shutter unit 100 may be shiftable between a closed state and an open state by varying of the postures of the first shutter member 101 and the second shutter member 102 relative to the housing 21. In the closed state, the shutter unit 100 may be extended and thereby cover a portion of the image carrying surface 11S of the photosensitive drum 11. In the open state, the shutter unit 100 may be retracted and thereby cause a larger portion of the image carrying surface 11S of the photosensitive drum 11 to be exposed.

The shutter unit 100 may correspond to a "shutter unit" in a specific but non-limiting embodiment of the technology. The first shutter member 101 may correspond to a "first shutter member" in a specific but non-limiting embodiment of the technology. The second shutter member 102 may correspond to a "second shutter member" in a specific but non-limiting embodiment of the technology.

The first shutter member 101 may include a first shaft 103, a second shaft 104, and a first flat portion 105. The first shaft 103 may be a round bar extending in the X-axis direction. The second shaft 104 may be a round bar extending in a direction parallel or substantially parallel to the first shaft 103. The first flat portion 105 may couple the first shaft 103 and the second shaft 104 to each other. The first flat portion 105 may be fixed to both the first shaft 103 and the second shaft 104. The first flat portion 105 may have a first inner surface 105S and a first outer surface 105SS. The first inner surface 105S may be able to oppose the image carrying surface 11S in the closed state. The first outer surface 105SS may be disposed on side opposite to the first inner surface 105S. For example, multiple first flat portions 105 may be provided as illustrated in FIG. 9A. A first opening 101K may be disposed between adjacent first flat portions 105.

A first end of the first shaft 103 may be provided with a lever 107. A second end of the first shaft 103 on opposite side to the lever 107 may be provided with a spring 106. The spring 106 may serve as an urging member. In the second example embodiment, multiple first flat portions 105 may be dispersedly disposed between the lever 107 at the first end and the spring 106 at the second end.

The first shutter member 101 may be held by the housing 21 in a pivotable manner. The first shutter member 101 may pivot about the rotational axis 103J of the first shaft 103 relative to the housing 21. A first rotation-angle restrictor 108 may be disposed on a portion of the second shaft 104 in the X-axis direction, as with the second shaft 612 in the first example embodiment described above. See FIG. 9B for the first rotation-angle restrictor 108.

Figure 10A:
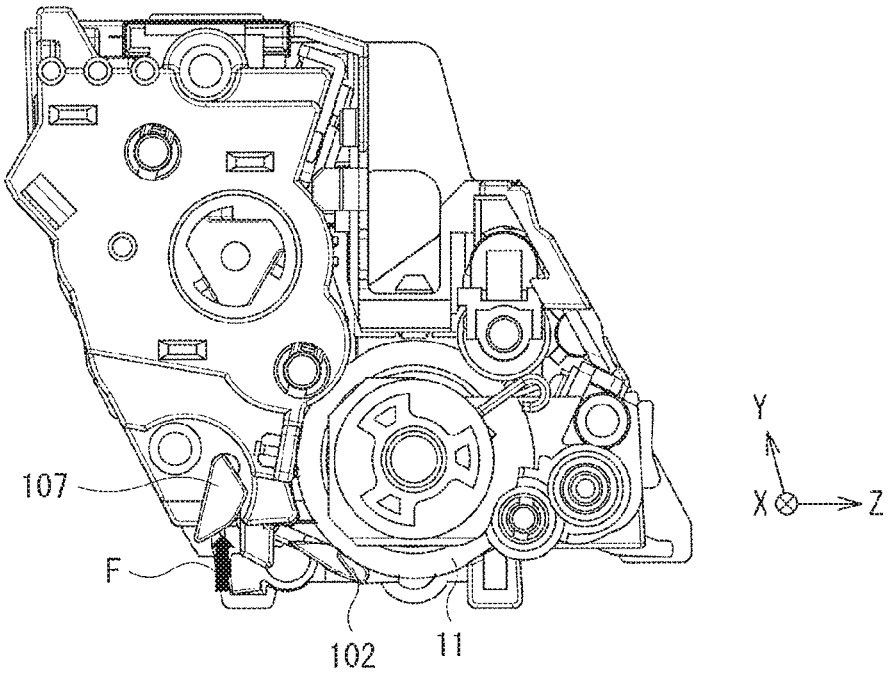
FIG. 10A is a side view of the image forming unit illustrated in FIG. 8A.
Figure 10B:
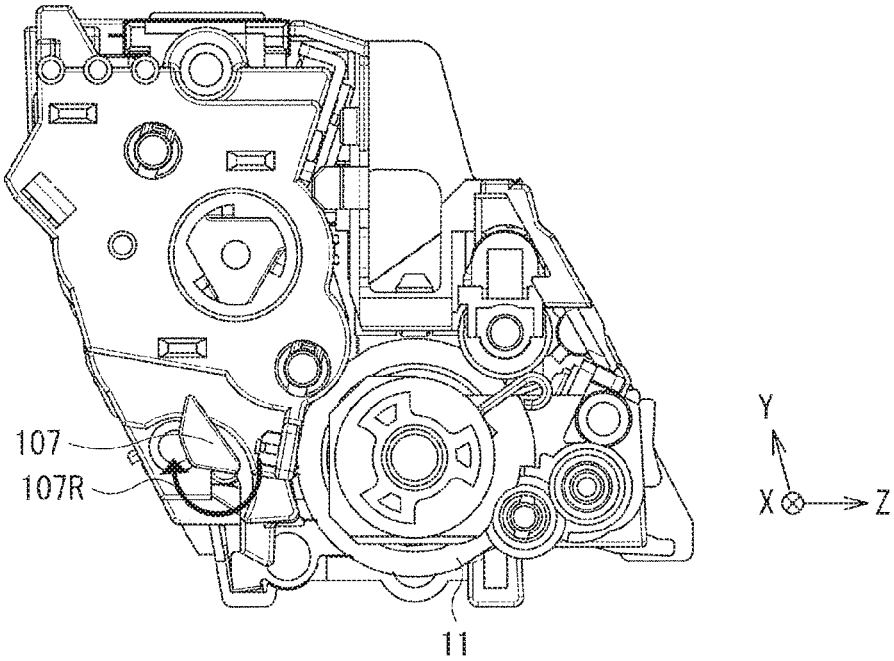
FIG. 10B is a side view of the image forming unit illustrated in FIG. 8B.

The lever 107 may be integrated with, for example but not limited to, the first shaft 103. The lever 107 may come into contact with, for example but not limited to, the protrusion 10T disposed on the inner surface of the housing 10 of the image forming apparatus illustrated in FIG. 1. The lever 107 may thereby receive force F from the protrusion 10T and rotate in a rotating direction 107R, as illustrated in FIGS. 10A and 10B. The protrusion 10T is illustrated in FIGS. 7A to 7C. The rotation of the lever 107 may cause the first shaft 103 or the first shutter member 101 to rotate about the rotational axis 103J. FIG. 10A illustrates the image forming unit 130 in the closed state in which the shutter unit 100 is extended. FIG. 10B illustrates the image forming unit 130 in the open state in which the shutter unit 100 is folded. When the image forming unit 130 is detached from the housing 10 of the image forming apparatus, the shutter unit 100 may be in the closed state. When the image forming unit 130 is mounted to the housing 10 of the image forming apparatus, the shutter unit 100 may be in the open state and thereby enables a print operation.

The spring 106 may be an urging member that applies urging force to the first shutter member 101 and thereby allow for state shifting from the open state to the closed state.

The second shutter member 102 may be held by the first shutter member 101 in a pivotable manner. The second shutter member 102 may pivot about a rotational axis 104J of the second shaft 104 relative to the first shutter member 101. The second shutter member 102 may include a gasping portion 109 and a second flat portion 110. The gasping portion 109 may support the second shaft 104 in a rotatable manner. The second flat portion 110 may be fixed to the grasping portion 109. In the second example embodiment, multiple gasping portions 109 may be disposed in the gaps between the first flat portions 105. The second flat portion 110 may further have a second inner surface 110S and a second outer surface 110SS. The second outer surface 110SS may be disposed on the side opposite to the second inner surface 110S. The second inner surface 110S may be able to oppose the image carrying surface 11S in the closed state. For example, multiple second flat portions 110 may be provided as illustrated in FIG. 9A. A second opening 102K may be disposed between adjacent second flat portions 110. In the open state, the shutter unit 100 may be so folded that the first flat portions 105 are disposed in the second openings 102K and the second flat portions 110 are disposed in the first openings 101K. A portion of the second flat portion 110 may be provided with a second rotation-angle restrictor 111 at a position corresponding to the first rotation-angle restrictor 108, as illustrated in FIG. 9A. The second rotation-angle restrictor 111 may come into contact with the first rotation-angle restrictor 108 in the closed state. The second shutter member 102 may include a first contact portion 102*a*, a second contact portion 102*b*, and a third contact portion 102*c*. The first contact portion 102*a*, the second contact portion 102*b*, and the third contact portion 102*c* may be disposed in the non-image-forming region positioned outside the image-forming region of the image carrying surface 11S in the longitudinal direction of the image forming unit 130, i.e., the X-axis direction. The first contact portion 102*a*, the second contact portion 102*b*, and the third contact portion 102*c* may come into contact with the guiding member 170 described below. The image-forming region may be a region in which the image to be transferred onto the medium PM is to be formed. The second shutter member 102 may be so held by the first shutter member 101 as to be rotatable about the second shaft 104. The first contact portion 102*a* may be disposed between the second contact portion 102*b* and the second shaft 104. The third contact portion 102*c* may be disposed between the second contact portion 102*b* and the first contact portion 102*a*.

The first contact portion 102*a* may correspond to a "first contact portion" in a specific but non-limiting embodiment of the technology. The second contact portion 102*b* may correspond to a "second contact portion" in a specific but non-limiting embodiment of the technology. The third contact portion 102*c* may correspond to a "third contact portion" in a specific but non-limiting embodiment of the technology.

[2.3 Configuration of Guiding Member 170]

Figure 11:
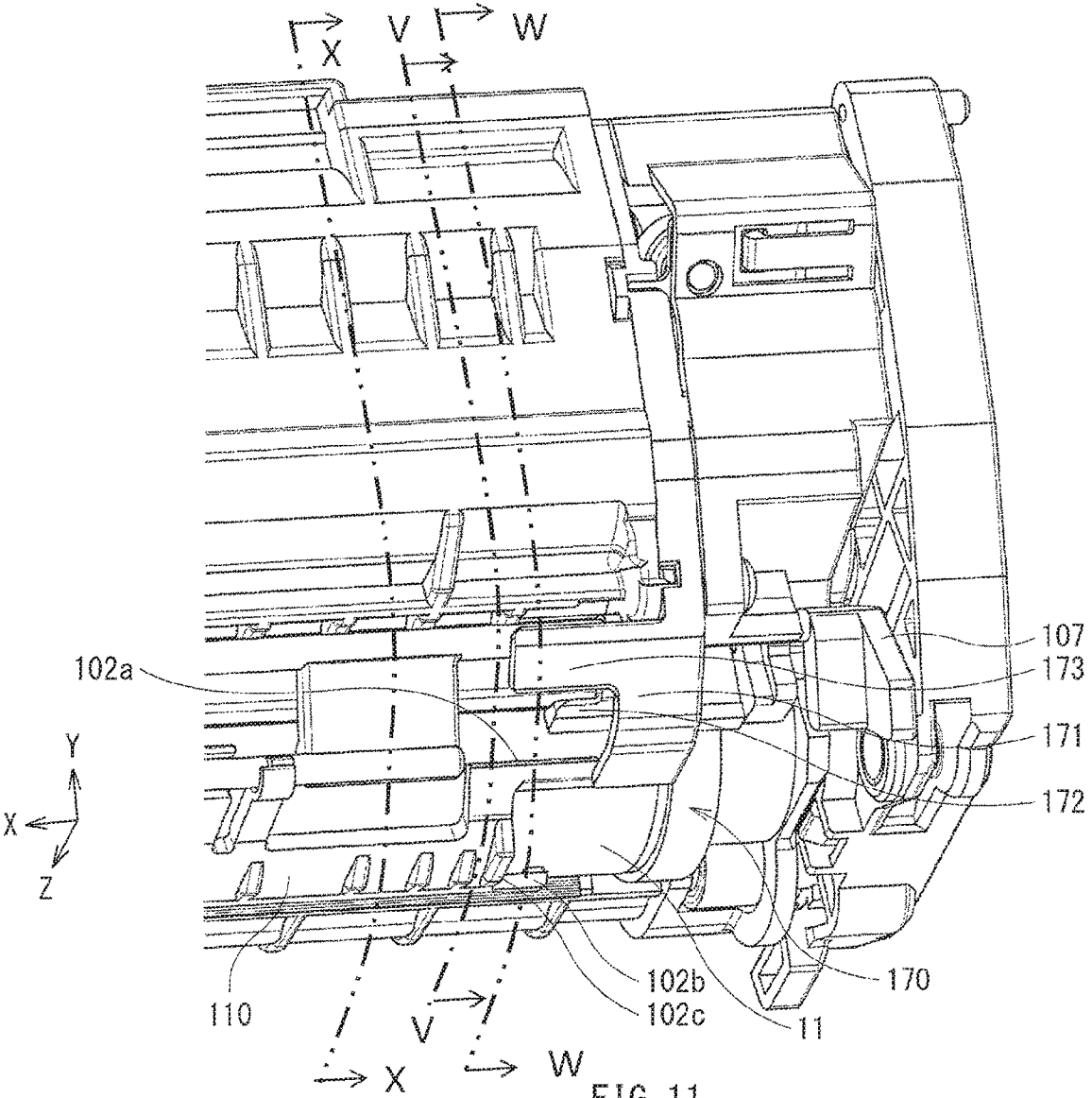
FIG. 11 is an enlarged partial perspective view of a lever and its vicinity in the image forming unit illustrated in FIG. 8A.

FIG. 11 is an enlarged view of the lever 107 and the vicinity of the lever 107 in the image forming unit 130 illustrated in FIG. 8A. The guiding member 170 may include a first guiding portion 171, a holding portion 172, and a second guiding portion 173, as illustrated in FIG. 10. The first guiding portion 171, the holding portion 172, and the second guiding portion 173 may be, for example, integrated and supported by, for example but not limited to, the housing 21. In one example, the first guiding portion 171, the holding portion 172, and the second guiding portion 173 may be separate components. In another example, any two components among the first guiding portion 171, the holding portion 172, and the second guiding portion 173 may be integrated into a single component.

The first guiding portion 171 may correspond to a "first guiding portion" in a specific but non-limiting embodiment of the technology. The holding portion 172 may correspond to a "holding portion" in a specific but non-limiting embodiment of the technology. The second guiding portion 173 may correspond to a "second guiding portion" in a specific but non-limiting embodiment of the technology.

Figure 12A:
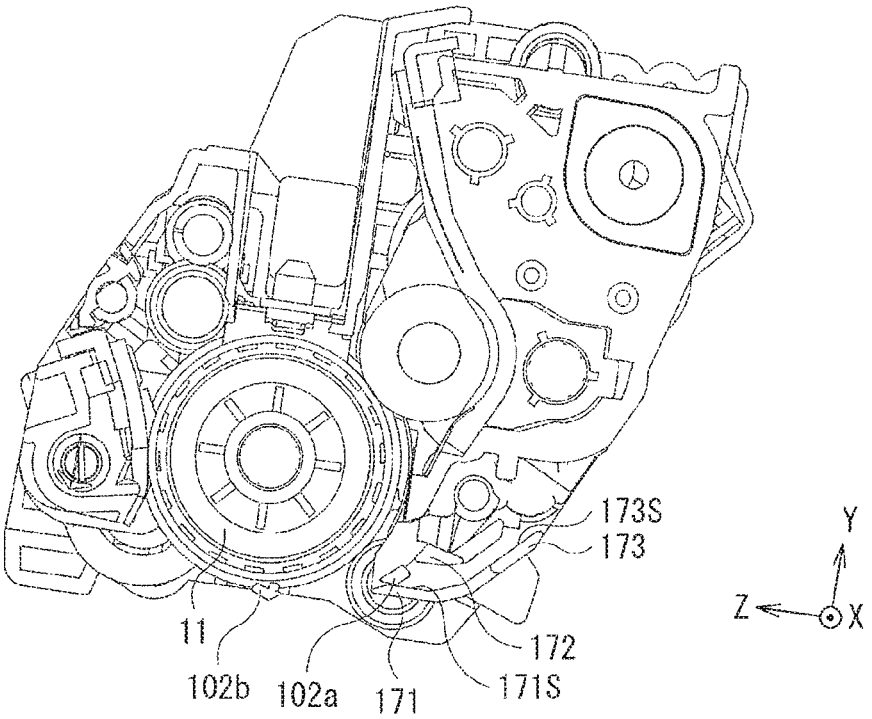
FIG. 12A is a cross-sectional view of the image forming unit at a first position at a time when the shutter unit illustrated in FIG. 8A shifts from the closed state to the open state.
Figure 12B:
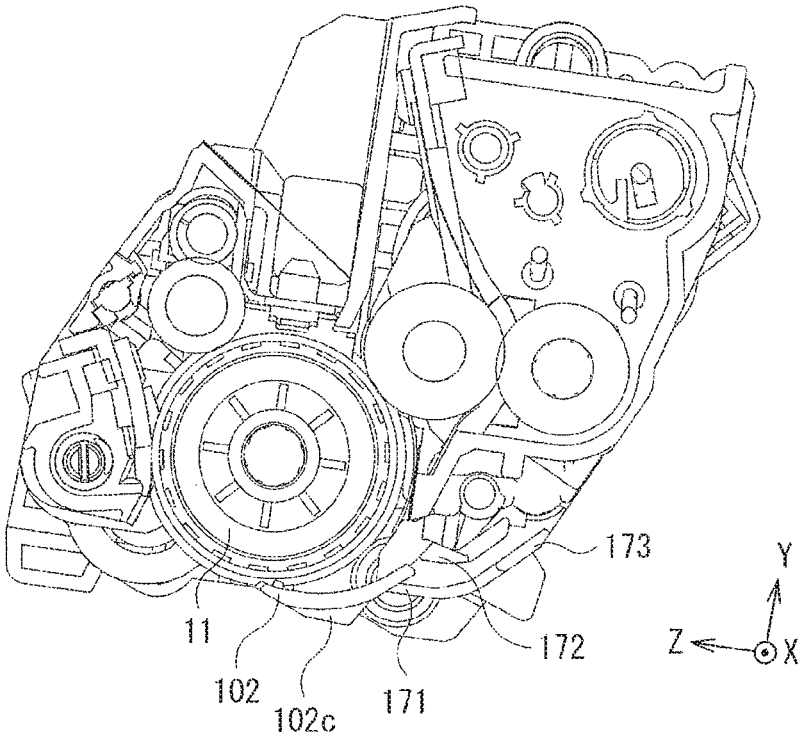
FIG. 12B is a cross-sectional view of the image forming unit at a second position at a time when the shutter unit illustrated in FIG. 8A shifts from the closed state to the open state.
Figure 13A:
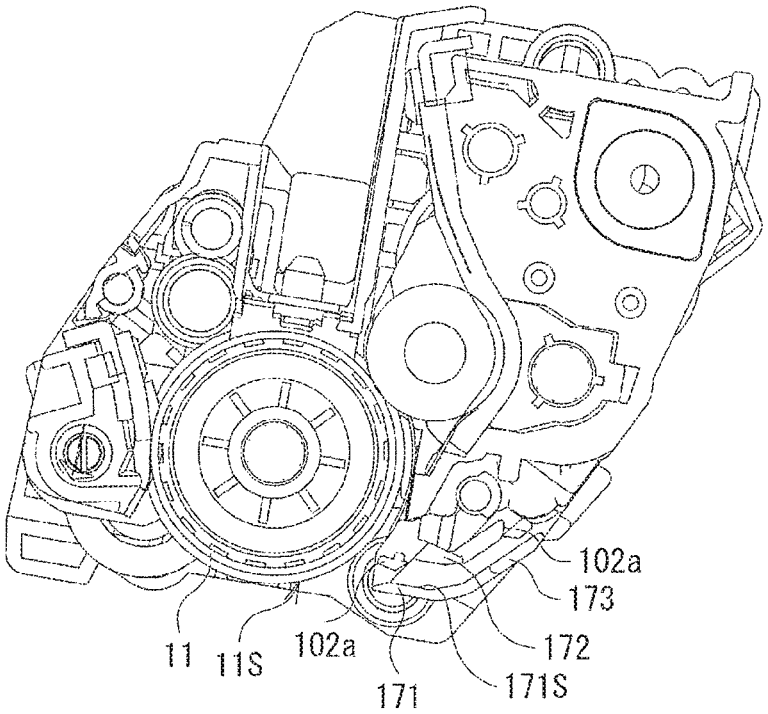
FIG. 13A is a cross-sectional view of the image forming unit at the first position following a stage illustrated in FIG. 12A.
Figure 13B:
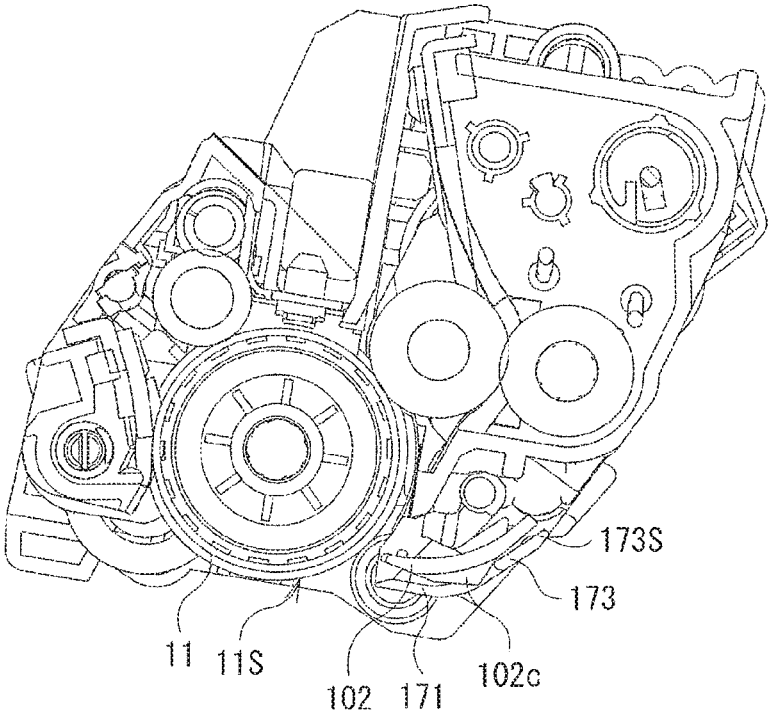
FIG. 13B is a cross-sectional view of the image forming unit at the second position following a stage illustrated in FIG. 12B.
Figure 14A:
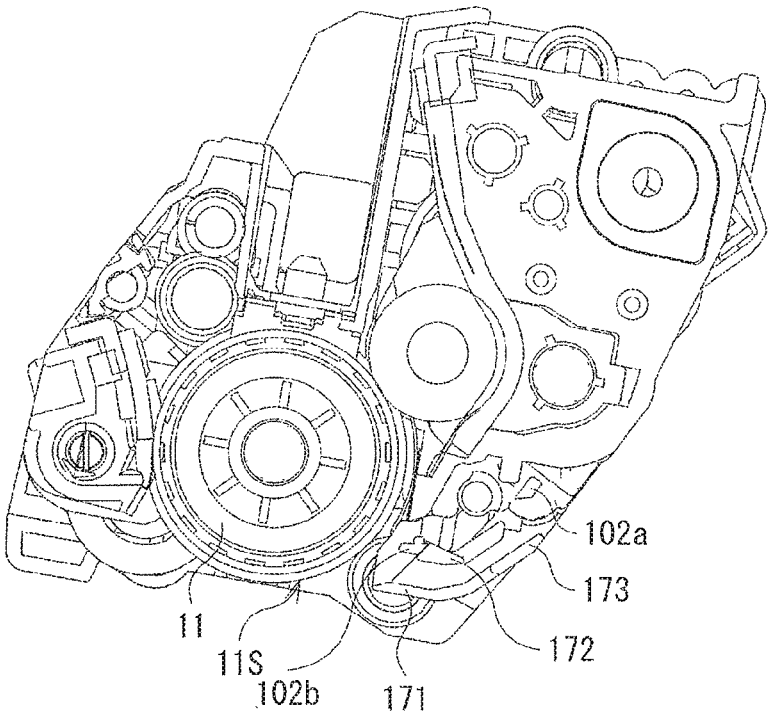
FIG. 14A is a cross-sectional view of the image forming unit at the first position following a stage illustrated in FIG. 13A.
Figure 14B:
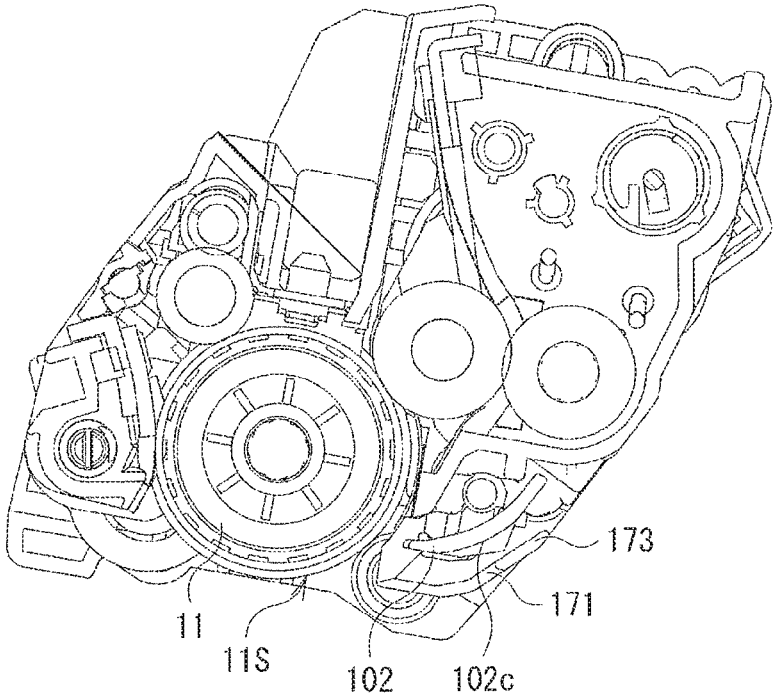
FIG. 14B is a cross-sectional view of the image forming unit at the second position following a stage illustrated in FIG. 13B.

FIGS. 12A and 12B are cross-sectional views of the image forming unit 130 in a middle state in which the shutter unit 100 is midway of shifting from the closed state to the open state. FIG. 12A illustrates a cross-section taken along a line V-V in FIG. 11. FIG. 12B illustrates a cross-section taken along a line W-W in FIG. 11. FIGS. 13A and 13B are cross-sectional views of the image forming unit 130 in a stage following that illustrated in FIGS. 12A and 12B. FIG. 13A illustrates a cross-section taken along the line V-V in FIG. 11. FIG. 13B illustrates a cross-section taken along the line W-W in FIG. 11. FIGS. 14A and 14B are cross-sectional views of the image forming unit 130 at a time when the shutter unit 100 is in the open state. FIG. 14A illustrates a cross-section taken along the line V-V in FIG. 11. FIG. 14B illustrates a cross-section taken along the line W-W in FIG. 11.

The first guiding portion 171 may be supported by the housing 21 in the non-image-forming region other than the image-forming region. As illustrated in FIGS. 12A to 14B, the first guiding portion 171 may come into contact with the first contact portion 102*a* in the non-image-forming region during the state shifting between the closed state illustrated in FIG. 10A and the open state illustrated in FIG. 10B. The first guiding portion 171 may come into contact with the first contact portion 102*a* in the non-image-forming region and thereby restrict the movement of the second shutter member 102 in a direction away from the image carrying surface 11S.

The holding portion 172 may be supported by the housing 21 in the non-image-forming region other than the image-forming region. The holding portion 172 may come into contact with the second contact portion 102*b* in the non-image-forming region and thereby maintain the open state of the shutter unit 100.

During the state shifting of the shutter unit 100 between the closed state and the open state, the second guiding portion 173 may come into contact with the third contact portion 102*c* after the first contact portion 102*a* and the first guiding portion 171 come into contact with each other. The second guiding portion 173 may thereby restrict the movement of the second shutter member 102 in the direction away from the image carrying surface 11S. During the state shifting from the closed state to the open state, the second guiding portion 173 may come into contact with the third contact portion 102*c* and thereby guide the third contact portion 102*c*. The second guiding portion 173 may thereby cause the second inner surface 110S to approach the first inner surface 105S. The third contact portion 102*c* may have a protruding portion that protrudes from the second outer surface 110SS in a direction opposite to the second inner surface 110S.

[2.4 Example Workings and Example Effects]

[Regarding Operation during State Shifting of Shutter Unit 100]

In the second example embodiment, similar to the image forming unit 30 described above, the shutter unit 100 in the closed state may shift to the open state when the image forming unit 130 is mounted at the predetermined position inside the housing 10 of the image forming apparatus.

Figure 15A:
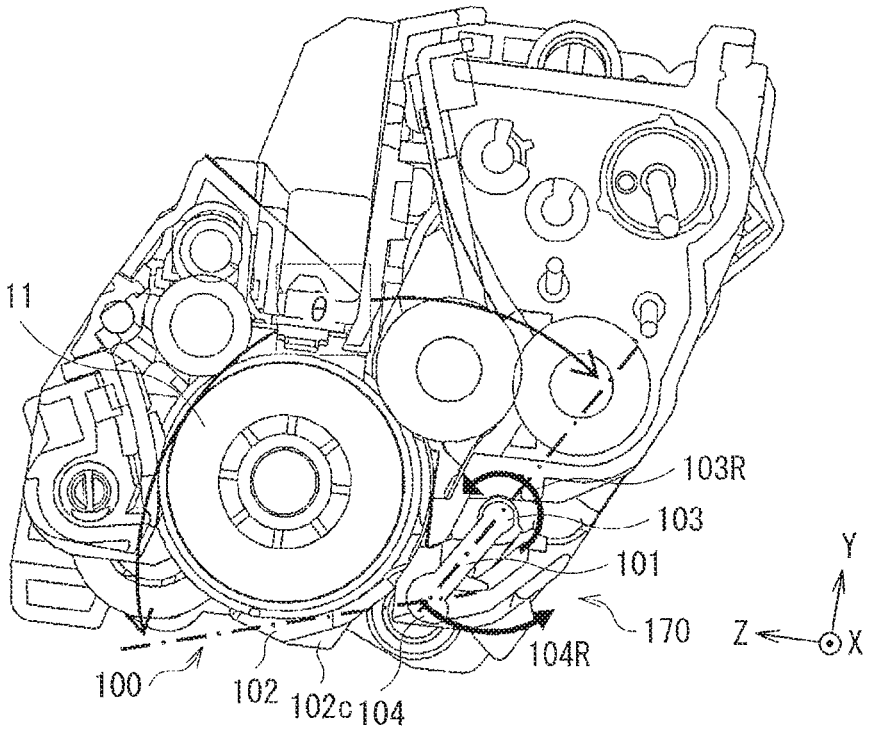
FIG. 15A is a cross-sectional view of the shutter unit illustrated in FIG. 8A during a state shifting operation.
Figure 15B:
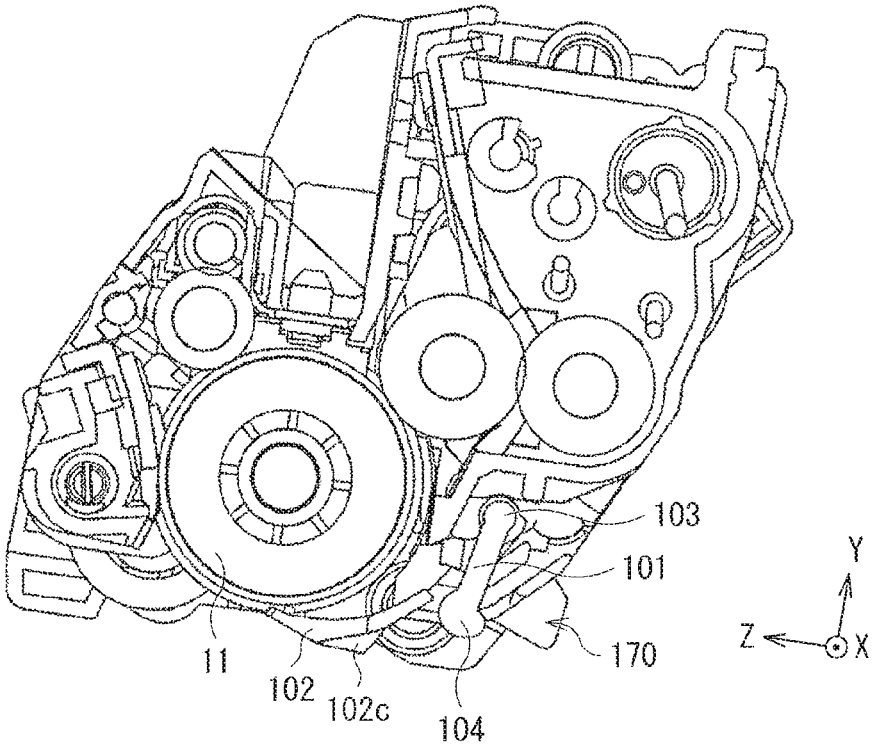
FIG. 15B is a cross-sectional view of the shutter unit during the state shifting operation following FIG. 15A.
Figure 15C:
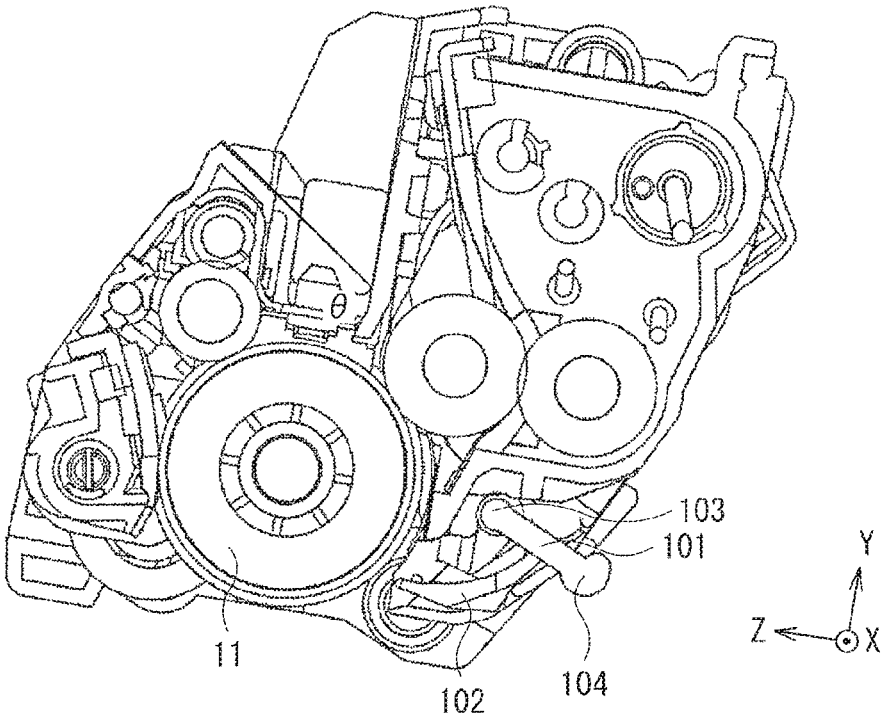
FIG. 15C is a cross-sectional view of the shutter unit during the state shifting operation following FIG. 15B.
Figure 15D:
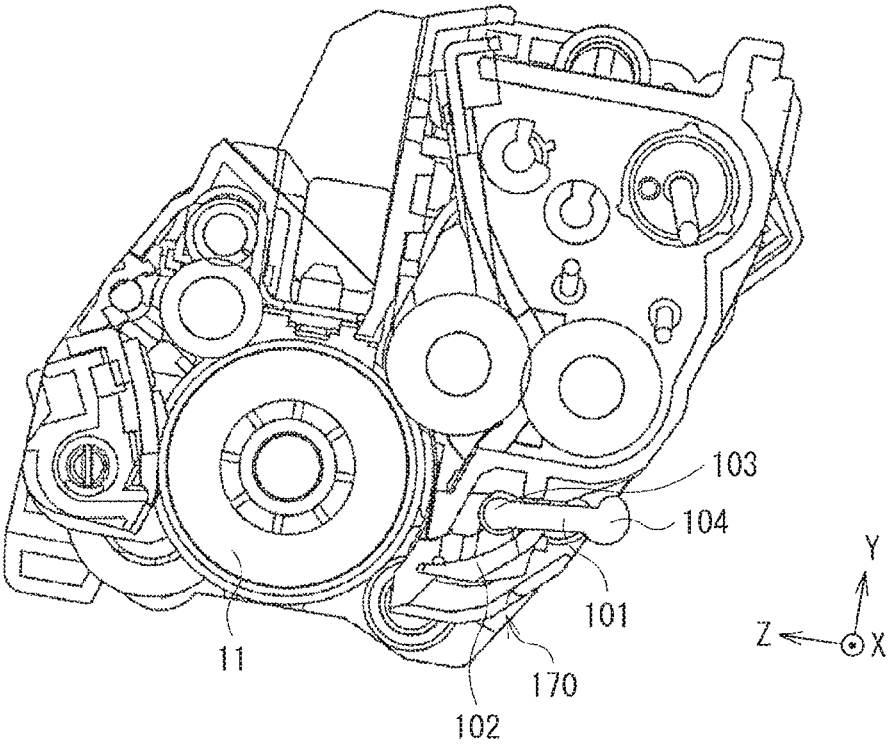
FIG. 15D is a cross-sectional view of the shutter unit during the state shifting operation following FIG. 15C.

For example, the shutter unit 100 in the closed state illustrated in FIG. 15A may shift to the open state illustrated in FIG. 15D via the first stage illustrated in FIG. 15B and the second stage illustrated in FIG. 15C. In the closed state, the second shutter member 102 of the shutter unit 100 may cover the image carrying surface 11S of the photosensitive drum 11. In the open state, it is possible to carry out printing. FIGS. 15A to 15D are cross-sectional views of the different stages in the state shifting operation of the shutter unit 100. The cross-sectional views are taken along a line X-X in FIG. 11. FIG. 15B corresponds to FIGS. 12A and 12B. FIG. 15C corresponds to FIGS. 13A and 13B. FIG. 15D corresponds to FIGS. 14A and 14B.

In the shutter unit 100, the lever 107 and the first shaft 103 may rotate together. Therefore, the lever 107 may receive force F and rotate in the rotating direction 107R, as illustrated in FIGS. 10A and 10B. The first shutter member 101 and the second shutter member 102 may thereby start, in association with each other, the state shifting from the closed state to the open state. At this time, the first rotation-angle restrictor 108 and the second rotation-angle restrictor 111 may be separated. The shutter unit 100 may then shift to the first stage illustrated in FIGS. 12A and 12B. In a specific but not-limiting example, the outer surface of the first contact portion 102*a* and a guiding surface 171S of the first guiding portion 171 may come into contact with each other, as illustrated in FIG. 12A. The outer surface of the first contact portion 102*a* may be guided by the first guiding portion 171 while the shutter unit 100 shifts to the second stage illustrated in FIGS. 13A and 13B. The first guiding portion 171 may so guide the outer surface of the first contact portion 102*a* as described above to restrict the second shutter member 102 from sagging, by its weight, outside of the housing 21 in the direction away from the image carrying surface 11S. The third contact portion 102*c* may not be in contact with the first guiding portion 171, as illustrated in FIG. 12B and FIG. 15B.

In this way, the first contact portion 102*a* of the second shutter member 102 may be guided by the guiding surface 171S of the first guiding portion 171. Therefore, it is possible to prevent the second shutter member 102 from separating, by its weight, from the image carrying surface 11S during the state shifting.

In the second stage illustrated in FIGS. 13A and 13B thereafter, the third contact portion 102*c* may come into contact with the guiding surface 173S of the second guiding portion 173. As a result, the first contact portion 102*a* may separate from the guiding surface 171S. When the lever 107 further rotates in the rotating direction 107R, the shutter unit 100 may be so folded gradually as to cause the second shutter member 102 to approach the first shutter member 101 while the third contact portion 102*c* is being guided by the guiding surface 173S. The rotating direction 107R is illustrated in FIG. 10B. Finally, the second contact portion 102*b* may come into contact with the holding portion 172, as illustrated in FIG. 14A. The shutter unit 100 may thereby shift to the open state. In the open state, the third contact portion 102*c* may be separated from the guiding surface 173S, as illustrated in FIG. 14B. In the open state, the holding portion 172 may come into contact with the second contact portion 102*b*, as illustrated in FIG. 14A. The second shutter member 102 may thereby be restricted from sagging, by its weight, below the housing 21 and interfering with another components, such as the transfer section 4.

In the second example embodiment, the shutter unit 100 and the guiding member 170 may have the configurations described above. Therefore, the shutter unit 100 may be able to smoothly shift from the closed state to the open state, regardless of the positions of the photosensitive drums 11 and the posture of the image forming units 130 relative to the housing 21. In the closed state, the image carrying surface 11S may be covered. In the open state, the image carrying surface 11S may be exposed. Furthermore, it is possible to reduce the space swept by the shutter unit 100 during the state shifting. As a result, according to the image forming unit 130 of the second example embodiment, it is possible to secure a superior image forming performance by protecting the image carrying surface 11S while achieving a small size.

In the second example embodiment, the first shutter member 101 may include the first rotation-angle restrictor 108. The second shutter member 102 may include the second rotation-angle restrictor 111. The first rotation-angle restrictor 108 and the second rotation-angle restrictor 111 may come into contact with each other in the closed state. The angle θ of the second shutter member 102 relative to the first shutter member 101 may thereby be restricted. Accordingly, the shutter unit 100 may support itself in the closed state without depending on the guiding member 170. That is, a separate component directed to supporting of the second shutter member 102 in the closed state may not be needed. Therefore, an unnecessary component may not be provided at a position covering the image carrying surface 11S in the open state. As a result, the exposure of the image carrying surface may not be interfered during use or during image formation.

In the second example embodiment, the guiding member 170 may be provided with the second guiding portion 173, and the second shutter member 102 may be provided with the third contact portion 102*c*. The second guiding portion 173 may come into contact with the third contact portion 102*c* after the first contact portion 102*a* and the first guiding portion 171 come into contact with each other while the shutter unit 100 shifts from the closed state to the open state. In this way, it is possible to restrict the movement of the second shutter member 102 in the direction away from the image carrying surface 11S also after the first contact portion 102*a* passes through the first guiding portion 171. As a result, it is possible to reliably prevent the second contact portion 102*b* of the second shutter member 102 from moving under the holding portion 172 due to insufficient holding of the second contact portion 102*b* by the holding portion 172. The guiding surface 171S of the first guiding portion 171 may be extended. However, in such a case, a longer stroke may be needed. It may be therefore difficult to efficiently use of the limited space.

In the second example embodiment, the first contact portion 102*a* may pass the outer side of the holding portion 172 while the state shifts from the closed state to the open state. The outer side of the holding portion 172 may be the side of the holding portion 172 opposite to the photosensitive drum 11. The third contact portion 102*c* may come into contact with the second guiding portion 173 after the first contact portion 102*a* passes the outer side of the holding portion 172. The second contact portion 102*b* may come into contact with the holding portion 172 after the third contact portion 102*c* comes into contact with the second guiding portion 173. Accordingly, it is possible to fold the shutter unit 100 without the first guiding portion 171, the holding portion 172, and the second guiding portion 173 protruding outside the trajectory of the second shutter member 102, for example, to a position far away from the housing 21 and the photosensitive drum 11.

When the state shifts from the closed state to the open state, the shutter unit 100 may be so folded that the first flat portions 105 are disposed in the second openings 102K and the second flat portions 110 are disposed in the first openings 101K. Therefore, in the open state, the thickness and the weight of the folded shutter unit 100 may be reduced, and thereby, it is possible to further downsize the shutter unit 100.

3. Modification Examples

Although the technology has been described above with reference to some example embodiments, the technology is not limited to the example embodiments described above and is modifiable in a variety of ways. Although the example embodiments have been described above with reference to the image forming apparatus that forms a color image, for example, the technology is not limited thereto. In one example embodiment, an image forming apparatus may be provided and thereby form a monochrome image, for example. Although the example embodiments have been described above with reference to the image forming apparatus of a direct transfer method, the technology is not limited thereto. One embodiment of the technology is also applicable to a secondary transfer method.

The structure, shape, and dimensional ratio of the shutter unit described in the example embodiments are mere examples and not limited thereto. This also applies to components besides the shutter unit.

In the first example embodiment described above, the first contact portion 623 and the second contact portion 624 may be disposed only in one position of the second shutter member 62 at the end in the X-axis direction. The technology, however, is not limited thereto. That is, in one example embodiment of the technology, multiple first contact portions and multiple contact portions may be disposed on the second shutter member. In one example embodiment of the technology, the first contact portions and the second contact portions may be disposed on, for example but not limited to, the two ends of the second shutter member in the X-axis direction. In such a case, for example, multiple guiding members may be disposed at positions corresponding to the first contact portions and the second contact portions. The guiding members may each include the guiding portion and the holding portion. One reason for this is that the multiple guiding members may restrict the first contact portions and the second contact portions of the second shutter member, and thereby, the shutter unit is stabilized during the state shifting between the closed state and the open state and while the open state is maintained. For example, in the case where the shutter unit includes a material such as resin, it is possible to restrict sagging of the second shutter member by its weight by bending of the shutter unit in a direction not restricted by the guiding members.

In the example embodiments described above, the exposure device may be an LED head including a light-emitting diode as a light source. Alternatively, an exposure device including a laser element as a light source, for example, may be used.

Although the example embodiments and the modification examples have been described above with reference to an image forming apparatus having a printing function as an example of the "image forming apparatus" according to one embodiment of the technology, the technology is not limited thereto. One example embodiment of the technology is also applicable to an image forming apparatus that serves as a multifunction peripheral having, for example, a scanning function or a facsimile function in addition to the printing function.

Furthermore, the technology encompasses any possible combination of some or all of the various embodiments and the modifications described herein and incorporated herein. It is possible to achieve at least the following configurations from the above-described example embodiments of the technology.

(1)

An image forming unit including:

an image carrier that includes an image carrying surface configured to carry a developer image:

a body that holds the image carrier with a portion of the image carrying surface being exposed;

a shutter unit including a first shutter member that is held by the body, being pivotable about a first rotational axis relative to the body, the first shutter member including a first inner surface, and a second shutter member that is held by the first shutter member, being pivotable about a second rotational axis relative to the first shutter member, the second rotational axis being parallel or substantially parallel to the first rotational axis, the second shutter member including a second inner surface, a first contact portion, and a second contact portion, the shutter unit being shiftable between a closed state and an open state, the closed state being a state in which the first shutter member and the second shutter member are extended with the first inner surface and the second inner surface covering the image carrying surface, the open state being a state in which the first shutter member and the second shutter member are folded with the first inner surface and the second inner surface opposing each other and with the image carrying surface being exposed;

a first guiding portion that is supported by the body, being opposing a non-image-forming region of the image carrying surface other than an image-forming region of the image carrying surface, the first guiding portion coming into contact with the first contact portion during state shifting between the closed state and the open state while restricting movement of the second shutter member in a direction away from the image carrying surface; and a holding portion that is supported by the body in the non-image-forming region, the holding portion coming into contact with the second contact portion and thereby maintaining the open state of the shutter unit.

(2)

The image forming unit according to (1), in which the first shutter member includes a first contact surface, the second shutter member includes a second contact surface that is in contact with the first contact surface in the closed state, and an angle of the second shutter member relative to the first shutter member is restricted by the first contact surface and the second contact surface coming into contact with each other in the closed state.

(3)

The image forming unit according to (1) or (2), in which a first distance from the first rotational axis to the first guiding portion on a cross-section orthogonal to the first rotational axis is larger than a second distance from the first rotational axis to the second rotational axis on the cross-section orthogonal to the first rotational axis.

(4)

The image forming unit according to (3), in which a third distance from the image carrying surface to the first guiding portion on the cross-section orthogonal to the first rotational axis is larger than a fourth distance from the image carrying surface to the first rotational axis on the cross-section orthogonal to the first rotational axis.

(5)

The image forming unit according to any one of (1) to (4), in which a first length of the first shutter member from the first rotational axis to the second rotational axis on a cross-section orthogonal to the first rotational axis is smaller than a second length of the second shutter member from the second rotational axis to a tip of the second shutter member on opposite side to the second rotational axis on the cross-section orthogonal to the first rotational axis.

(6)

The image forming unit according to any one of (1) to (5), in which the first guiding portion is spaced away from the first contact portion in the open state.

(7)

The image forming unit according to any one of (1) to (6), in which, during the state shifting, rotation of the first rotational axis causes the first shutter member and the second shutter member to rotate in association with each other.

(8)

The image forming unit according to (7), in which, during the state shifting, the first shutter member rotates in a first rotating direction relative to the body, and the second shutter member rotates in a second rotating direction relative to the first shutter member, the second rotating direction being opposite to the first rotating direction.

(9)

The image forming unit according to any one of (1) to (8), in which the state shifting is performed without allowing a portion or all of the shutter unit to be present outside a region overlaying the body on a cross-section orthogonal to the first rotational axis.

(10)

The image forming unit according to any one of (1) to (9), in which the second inner surface of the second shutter member includes a protrusion that is configured to come into contact with the non-image-forming region of the image carrying surface other than the image-forming region.

(11)

The image forming unit according to (1), further including a second guiding portion supported by the body in the non-image-forming region, in which the second shutter member further includes a third contact portion, and the second guiding portion comes into contact with the third contact portion after the first contact portion and the first guiding portion come into contact with each other, and thereby restricts movement of the second shutter member in a direction away from the image carrying surface, during the state shifting between the closed state and the open state.

(12)

The image forming unit according to (11), in which the second guiding portion comes into contact with and guides the third contact portion and thereby causes the second inner surface to approach the first inner surface, during the state shifting between the closed state and the open state.

(13)

The image forming unit according to (11) or (12), in which the first shutter member further includes a first outer surface on side opposite to the first inner surface, the second shutter member further includes a second outer surface on side opposite to the second inner surface, and the third contact portion further includes a protruding portion protruding from the second outer surface in a direction away from the second inner surface.

(14)

The image forming unit according to any one of (11) to (13), in which the first contact portion passes outer side of the holding portion, the outer side of the holding portion being side of the holding portion opposite to the image carrier during the state shifting from the closed state to the open state, the third contact portion comes into contact with the second guiding portion after the first contact portion passes the outer side of the holding portion during the state shifting from the closed state to the open state, and the second contact portion comes into contact with the holding portion after the third contact portion comes into contact with the second guiding portion during the state shifting from the closed state to the open state.

(15)

The image forming unit according to any one of (1) to (13), in which the first shutter member has a first flat portion and a first opening, the second shutter member has a second flat portion and a second opening, and the shutter unit is folded in the closed state with the first flat portion being accommodated in the second opening and the second flat portion being accommodated in the first opening.

(16)

The image forming unit according to any one of (11) to (15), in which the second shutter member is held by the first shutter member, being rotatable about the second rotational axis, and in the second shutter member, the first contact portion is disposed between the second contact portion and the second rotational axis, and the third contact portion is disposed between the second contact portion and the first contact portion.

(17)

The image forming unit according to any one of (1) to (16), in which the second contact portion is held by the holding portion in the open state with a portion or all of the second contact portion being present on or above the holding portion.

(18)

An image forming apparatus including an image forming unit according to any one of (1) to (17).

(19)

The image forming apparatus according to (18), in which the developer image is transferred onto a medium by causing the image carrying surface to come into direct contact with the medium.

The image forming unit and the image forming apparatus according to one embodiment of the technology have the respective configurations described above. Therefore, the shutter unit is able to smoothly shift from the closed state to the open state, regardless of the positions of the image carrier and the image forming unit relative to the body. In the closed state, the image carrying surface is covered. In the open state, the image carrying surface is exposed. Furthermore, it is possible to reduce the space swept by the shutter unit during the state shifting.

According to an image forming unit and an image forming apparatus of one embodiment of the technology, it is possible to secure a superior image forming performance through protection of an image carrying surface while achieving a small size. The effects of the technology are not limited to those described above and may include any of the effects described below.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An image forming unit comprising:

a photosensitive drum that includes an image carrying surface configured to carry a developer image;

a body that holds the photosensitive drum with a portion of the image carrying surface being exposed;

a shutter unit including a first shutter member that is held by the body, being pivotable about a first rotational axis relative to the body, the first shutter member including a first inner surface, and a second shutter member that is held by the first shutter member, being pivotable about a second rotational axis relative to the first shutter member, the second rotational axis being parallel or substantially parallel to the first rotational axis, the second shutter member including a second inner surface, a first contact portion, and a second contact portion, the shutter unit being shiftable between a closed state and an open state, the closed state being a state in which the first shutter member and the second shutter member are extended with the first inner surface and the second inner surface covering the image carrying surface, the open state being a state in which the first shutter member and the second shutter member are folded with the image carrying surface being exposed;

a first guiding surface that is supported by the body, the first guiding surface being provided on an opposite side of the photosensitive drum with the shutter unit being interposed between the first guiding surface and the photosensitive drum, and guiding the second shutter member;

a holder that is supported by the body, the holder coming into contact with the second contact portion when the shutter unit is in the open state and thereby holding the shutter unit; and a second guiding surface supported by the body, and provided on the opposite side of the photosensitive drum with the shutter unit being interposed between the second guiding surface and the photosensitive drum, wherein the image forming unit is attachable to and detachable from an image forming apparatus, the second shutter member further includes a third contact portion, and the second guiding surface comes into contact with the third contact portion after the first contact portion and the first guiding surface come into contact with each other during the state shifting between the closed state and the open state.

2. The image forming unit according to claim 1, wherein the first shutter member includes a first contact surface, the second shutter member includes a second contact surface that is in contact with the first contact surface in the closed state, and an angle of the second shutter member relative to the first shutter member is restricted by the first contact surface and the second contact surface coming into contact with each other in the closed state.

3. The image forming unit according to claim 1, wherein a first distance from the first rotational axis to the first guiding surface on a cross-section orthogonal to the first rotational axis is larger than a second distance from the first rotational axis to the second rotational axis on the cross-section orthogonal to the first rotational axis.

4. The image forming unit according to claim 3, wherein a third distance from the image carrying surface to the first guiding surface on the cross-section orthogonal to the first rotational axis is larger than a fourth distance from the image carrying surface to the first rotational axis on the cross-section orthogonal to the first rotational axis.

5. The image forming unit according to claim 1, wherein a first length of the first shutter member from the first rotational axis to the second rotational axis on a cross-section orthogonal to the first rotational axis is smaller than a second length of the second shutter member from the second rotational axis to a tip of the second shutter member on opposite side to the second rotational axis on the cross-section orthogonal to the first rotational axis.

6. The image forming unit according to claim 1, wherein the first guiding surface is spaced away from the first contact portion in the open state.

7. The image forming unit according to claim 1, wherein, during the state shifting, rotation of the first rotational axis causes the first shutter member and the second shutter member to rotate in association with each other.

8. The image forming unit according to claim 7, wherein, during the state shifting, the first shutter member rotates in a first rotating direction relative to the body, and the second shutter member rotates in a second rotating direction relative to the first shutter member, the second rotating direction being opposite to the first rotating direction.

9. The image forming unit according to claim 1, wherein the state shifting is performed without allowing a portion or all of the shutter unit to be present outside a region overlaying the body on a cross-section orthogonal to the first rotational axis.

10. The image forming unit according to claim 1, wherein the second inner surface of the second shutter member includes a protrusion that is configured to come into contact with a region of the image carrying surface other than the image-forming region.

11. The image forming unit according to claim 1, wherein the second guiding surface comes into contact with and guides the third contact portion and thereby causes the second inner surface to approach the first inner surface, during the state shifting between the closed state and the open state.

12. The image forming unit according to claim 1, wherein, the first shutter member further includes a first outer surface on side opposite to the first inner surface, the second shutter member further includes a second outer surface on side opposite to the second inner surface, and the third contact portion further includes a protrusion protruding from the second outer surface in a direction away from the second inner surface.

13. The image forming unit according to claim 1, wherein the first contact portion passes outer side of the holder, the outer side of the holder being side of the holder opposite to the photosensitive drum during the state shifting from the closed state to the open state, the third contact portion comes into contact with the second guiding surface after the first contact portion passes the outer side of the holder during the state shifting from the closed state to the open state, and the second contact portion comes into contact with the holder after the third contact portion comes into contact with the second guiding surface during the state shifting from the closed state to the open state.

14. The image forming unit according to claim 1, wherein the first shutter member has a first flat portion and a first opening, the second shutter member has a second flat portion and a second opening, and the shutter unit is folded in the closed state with the first flat portion being accommodated in the second opening and the second flat portion being accommodated in the first opening.

15. The image forming unit according to claim 1, wherein the second shutter member is held by the first shutter member, being rotatable about the second rotational axis, and in the second shutter member, the first contact portion is disposed between the second contact portion and the second rotational axis, and the third contact portion is disposed between the second contact portion and the first contact portion.

16. The image forming unit according to claim 1, wherein the second contact portion is held by the holder in the open state with a portion or all of the second contact portion being present on or above the holder.

17. An image forming apparatus comprising the image forming unit of claim 1.

18. The image forming apparatus according to claim 17, wherein the developer image is transferred onto a medium by causing the image carrying surface to come into direct contact with the medium.

* * * * *